US006596976B2

(12) United States Patent
Lin et al.

(10) Patent No.: US 6,596,976 B2
(45) Date of Patent: Jul. 22, 2003

(54) METHOD AND SYSTEM FOR POINTING AND STABILIZING A DEVICE

(75) Inventors: Ching-Fang Lin, Simi Valley, CA (US); Hiram McCall, Simi Valley, CA (US)

(73) Assignee: American GNC Corporation, Simi Valley, CA (US)

( * ) Notice: Subject to any disclaimer, the term of this patent is extended or adjusted under 35 U.S.C. 154(b) by 0 days.

(21) Appl. No.: 09/732,648

(22) Filed: Dec. 7, 2000

(65) Prior Publication Data

US 2003/0105588 A1 Jun. 5, 2003

Related U.S. Application Data

(60) Provisional application No. 60/169,501, filed on Dec. 7, 1999.

(51) Int. Cl.[7] ..... F41G 7/00; F42B 10/02; F42B 15/01

(52) U.S. Cl. ..... 244/3.2; 244/3.15; 244/3.16; 244/3.19; 244/3.21; 342/61; 342/62; 342/63; 342/73; 342/74; 342/75

(58) Field of Search ..... 244/3.1, 3.15, 244/3.16–3.23, 3.11–3.14; 342/73–81, 52–66; 701/207, 220; 74/5, 22; 356/139.04, 139.06, 139.05, 139.07, 139.08, 4.01, 5.01–5.08

(56) References Cited

U.S. PATENT DOCUMENTS

| | | | | |
|---|---|---|---|---|
| 3,421,716 A | * | 1/1969 | Altekruse et al. | 244/3.17 |
| 3,731,544 A | * | 5/1973 | Acker et al. | 74/5.22 |
| 3,876,308 A | * | 4/1975 | Alpers | 356/139.06 |
| 3,883,091 A | * | 5/1975 | Schaefer | 244/3.13 |
| 4,010,467 A | * | 3/1977 | Slivka | 342/77 |
| 4,173,785 A | * | 11/1979 | Licata | 701/220 |

* cited by examiner

*Primary Examiner*—Bernarr E. Gregory
(74) *Attorney, Agent, or Firm*—Raymond Y. Chan; David and Raymond Patent Group

(57) ABSTRACT

A method and system for pointing and stabilizing a device that needs to be pointed and stabilized with a desired direction, are disclosed, wherein current attitude measurement and attitude rate measurement of the device measured by an attitude producer, which includes an inertial measurement unit, and the desired direction information measured by a target coordinates producer are processed by a pointing controller to compute rotation commands to an actuator. An actuator rotates and stabilizes the device at the desired direction according to the rotation commands in the presence of disturbances and parametric uncertainties to account for the undesired vibration due to disturbances. A visual and voice device provide an operator with visualization and voice indication of the pointing and stabilization procedure of the device.

62 Claims, 30 Drawing Sheets

METHOD AND SYSTEM FOR POINTING AND STABILIZING A DEVICE

CROSS REFERENCE OF RELATED APPLICATION

This is a regular application of the provisional application having an application number of No. 60/169,501 and a filing date of Dec. 7, 1999.

BACKGROUND OF THE PRESENT INVENTION

1. Field of the Present Invention

The present invention relates to a controlling method and system for positioning measurement, and more particularly to a method and system for pointing and stabilization a device that needs to be pointed at a determined direction, wherein output data of an IMU (Inertial Measurement Unit) installed in the device and target information date are processed to compute a rotation command to an actuator; the actuator rotates and stabilizes the device into the determined direction according to the rotation commands; a visual and voice device provide a user with visualization and voice indication of the pointing and stabilization procedure of the device.

2. Description of Related Arts

In many applications, a user needs to command a device to be pointed and stabilized with specified orientation. For example, an antenna or a transmitter and receiver beam in a mobile communication system carried in a vehicle needs to be pointed at a communication satellite in orbit in dynamic environments. Of, a sniper rifle in the hands of a warrior of an Army elite sniper team needs to be pointed at a hostile target in a complex environment. A measurement device in a land survey system needs to be pointed at a specific direction with precision and stabilized.

Conventional pointing and stabilization systems are used only in large military weapon systems, or commercial equipment, which use conventional expensive, large, heavy, and high power consumption spinning iron wheel gyros and accelerometers as motion sensing devices. Their cost, size, and power prohibit them from use in the emerging commercial applications, including phased array antennas for mobile communication systems.

Conventional gyros and accelerometers, which are commonly used in inertial systems to sense rotation and translation motion of a carrier, include: Floated Integrating Gyros (FIG), Dynamically-Tuned Gyros (DTG), Ring Laser Gyros (RLG), Fiber-Optic Gyros (FOG), Electrostatic Gyros (ESG), Josephson Junction Gyros (JJG), Hemisperical Resonating Gyros (HRG), Pulsed Integrating Pendulous Accelerometer (PIPA), Pendulous Integrating Gyro Accelerometer (PIGA), etc.

New horizons are opening up for inertial sensor technologies. MEMS (MicroElectronicMechanicalSystem) inertial sensors offer tremendous cost, size, and reliability improvements for guidance, navigation, and control systems, compared with conventional inertial sensors. It is well known that the silicon revolution began over three decades ago, with the introduction of the first integrated circuit. The integrated circuit has changed virtually every aspect of our lives. The hallmark of the integrated circuit industry over the past three decades has been the exponential increase in the number of transistors incorporated onto a single piece of silicon. This rapid advance in the number of transistors per chip leads to integrated circuits with continuously increasing capability and performance. As time has progressed, large, expensive, complex systems have been replaced by small, high performance, inexpensive integrated circuits. While the growth in the functionality of microelectronic circuits has been truly phenomenal, for the most part, this growth has been limited to the processing power of the chip.

MEMS, or, as stated more simply, micromachines, are considered the next logical step in the silicon revolution. It is believed that this next step will be different, and more important than simply packing more transistors onto silicon. The hallmark of the next thirty years of the silicon revolution will be the incorporation of new types of functionality onto the chip structures, which will enable the chip to, not only think, but to sense, act, and communicate as well.

MEMS exploits the existing microelectronics infrastructure to create complex machines with micron feature sizes. These machines can have many functions, including sensing, communication, and actuation. Extensive applications for these devices exist in a wide variety of commercial systems.

Therefore, it is possible to develop a pointing and stabilization system for a device incorporating the MEMS technologies.

SUMMARY OF THE PRESENT INVENTION

The main objective of the present invention is to provide a method and system for pointing and stabilizing a device which needs to be pointed and stabilized with a determined orientation, wherein output signals of an inertial measurement unit and the desired direction information are processed to compute rotation commands to an actuator; the actuator rotates and stabilizes the device at the desired direction according to the rotation commands.

Another objective of the present invention is to provide a method and system for pointing and stabilizing a device, which needs to be pointed and stabilized at a desired orientation, wherein a visual and voice device is attached to provide a user with visualization and voice indications of targets and the pointing and stabilization operational procedure.

Another objective of the present invention is to provide a method and system for pointing and stabilizing a device which needs to be pointed and stabilized with a determined orientation, wherein the pointing and stabilization system has increased accuracy that an increase in the system's ability to reproduce faithfully the output pointing direction dictated by the desirable direction.

Another objective of the present invention is to provide a method and system for pointing and stabilizing a device, which can reduce sensitivity to disturbance, wherein the fluctuation in the relationship of system output pointing direction to the input desirable direction caused by changes within the system are reduced. The values of system components change constantly through their lifetime, but using the self-correcting aspect of feedback, the effects of these changes can be minimized. The device to be pointed is often subjected to undesired disturbances resulting from structural and thermal excitations. To aggravate the problem, disturbance profiles throughout the mission may have different characteristics.

Another objective of the present invention is to provide a method and system for pointing and stabilizing a device, which is more smoothing and filtering that the undesired effects of noise and distortion within the system are reduced.

Another objective of the present invention is to provide a method and system for pointing and stabilizing a device, which can increase bandwidth that the bandwidth of the system is defined as a range of frequencies or changes to the input desired direction to which the system will respond satisfactorily.

Another objective of the present invention is to provide a method and system for pointing and stabilizing a device, wherein the pointed and stabilized device may be very diverse, including:

(a) Antennas for a wireless communication system, (b) Radar beams, (c) Laser beam, (d) Gun barrels, including sniper rifles, machine guns, (e) Measurement devices for a land survey.

DETAIL DESCRIPTION OF THE PREFERRED EMBODIMENT

Figure 1:
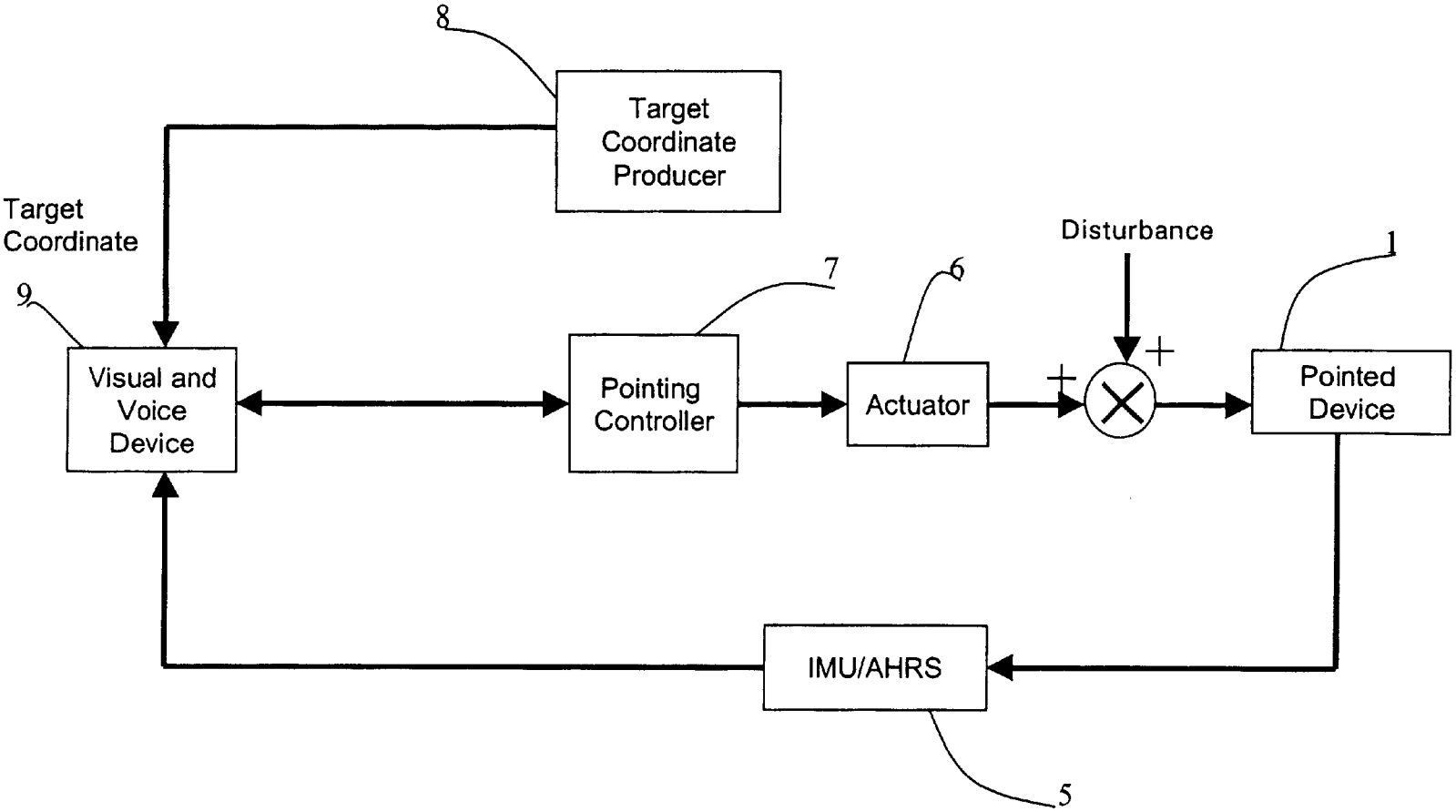
FIG. 1 is a block diagram illustrating the system according a preferred embodiment of the present invention.

Referring to FIGS. 1 to 30, a method and system for pointing and stabilizing a device, which needs to be pointed and stabilized at a determined orientation, according to a preferred embodiment of the present invention is illustrated.

Rapid advance in MEMS technologies makes it possible to fabricate low cost, lightweight, miniaturized size, and low power gyros and accelerometers. "MEMS" stands for "MicroElectroMechanical Systems", or small integrated electrical/mechanical devices. MEMS devices involve creating controllable mechanical and movable structures using IC (Integrated Circuit) technologies. MEMS includes the, concepts of integration of Microelectronics and Micromachining. Examples of successful MEMS devices include inkjet-printer cartridges, accelerometers that deploy car airbags, and miniature robots.

Microelectronics, the development of electronic circuitry on silicon chips, is a very well developed and sophisticated technology. Micromachining utilizes process technology developed by the integrated circuit industry to fabricate tiny sensors and actuators on silicon chips. In addition to shrinking the sensor size by several orders of magnitude, integrated electronics can be placed on the same chip, creating an entire system on a chip. This instrument will result in, not only a revolution in conventional military and commercial products, but also new commercial applications that could not have existed without small, inexpensive inertial sensors.

MEMS (MicroElectronicMechanicalSystem) inertial sensors offer tremendous cost, size, reliability improvements for guidance, navigation, and control systems, compared with conventional inertial sensors.

The applicants invent a micro IMU (Inertial Measurement Unit) and a COREMICRO™ IMU and file patent applications on Jan. 4, 2000, application Ser. No. 09/477,151, now U.S. Pat. No. 6,456,939, and Jul. 25, 2000, application Ser. No. 09/624,366 now U.S. Pat. No. 6,522,992, respectively. The generic terminology for either the micro IMU or the COREMICRO™ IMU is "IMU", that is "The world's smallest" IMU, which is based on the combination of solid state MicroElectroMechanical Systems (MEMS) inertial sensors and Application Specific Integrated Circuits (ASIC) implementation. The COREMICRO™ IMU is a fully self contained motion-sensing unit. It provides angle increments, velocity increments, a time base (sync) in three axes and is capable of withstanding high vibration and acceleration. COREMICRO™ IMU is opening versatile commercial applications, in which conventional IMUs can not be applied. They include land navigation, automobiles, personal hand-held navigators, robotics, marine users and unmanned air users, various communication, instrumentation, guidance, navigation, and control applications.

The COREMICRO™IMU makes it possible to build a low-cost, low-weight, and small-size pointing and stabilization system for a device.

It is worth to mention that although the COREMICRO™ Is preferred for the present invention, the present invention is not limited to the COREMICRO™ IMU. Any IMU device with such specifications can be used in the system of the present invention.

Referring to FIG. 1, the pointing and stabilization system of the present invention for a device comprises an attitude producer 5, a target coordinate producer 8, a pointing controller 7, an actuator 6, and a visual and voice device 9.

The attitude producer 5 includes an IMU/AHRS (Inertial Measurement Unit/Attitude and Heading Reference System) device or GPS (Global Positioning System) attitude receiver for determining current attitude and attitude rate measurements of a device 1.

The target coordinate product 8 is adapted for measuring the desired point direction of the device 1 by acquiring and tracking a target.

The pointing controller 7 is adapted for computing rotation commands to an actuator 6 using the desired pointing direction of the device and the current attitude measurement of the device 1 to rotate the device 1.

The actuator 6 is adapted for rotating the device 1 to the desired pointing direction.

The visual and voice device 9, which can be a hand-held or head-up device or others, is adapted for providing the operator with audio and visual means to improve his/her decision, including displaying the desired pointing direction and current attitude of the device, target trajectory, and producing a voice representing the pointing procedure.

The pointing and stabilization system of the present invention is a feedback control system. The operator uses the target coordinate producer 8 to capture and track a target to measure the desired point direction of the pointed device 1. The IMU/AHRS 5 is used to measure the current attitude of the pointed device 1. Using errors between the desired point direction and current direction of the pointed device 1, the pointing controller 7 determines rotation commands to the actuator 6. The actuator 6 changes the current attitude of the pointed device 1 to bring it into closer correspondence with the desired orientation.

Since arbitrary disturbances and unwanted fluctuations can occur at various points in the system of the present invention, the system of the present invention must be able to reject or filter out these fluctuations and perform its task with the prescribed accuracy, while producing as faithful a representation of the desirable pointing direction as feasible. This function of the filtering and smoothing is achieved by the above mentioned pointing controller with different types of feedback approaches, namely:

(a) Angle position feedback, (b) Angular rate and acceleration feedback.

The target coordinate producer 8 includes an Infrared sensor (IR), RF (Radio Frequency) radar, Laser radar (LADAR), and CCD (Charge Couple Devices) camera, or a multisensor data fusion system. Multisensor data fusion is an evolving technology that is analogous to the cognitive process used by humans to integrate data from their senses (sights, sounds, smells, tastes, and touch) continuously and make inferences about the external world.

Figure 2:
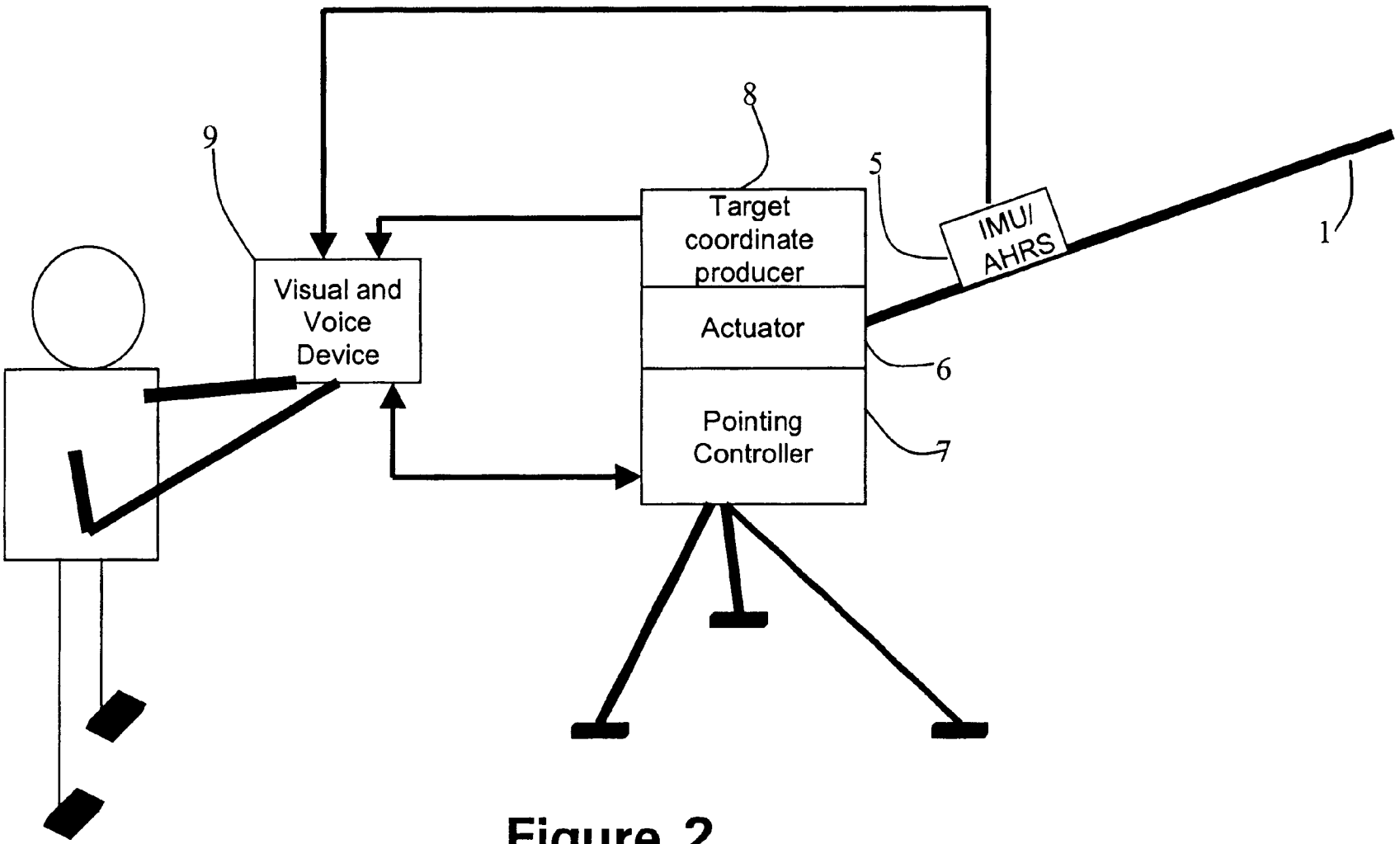
FIG. 2 is a block diagram illustrating the machine gun application according to the above preferred embodiment of the present invention.

In general, the benefit of employing multisensor data fusion system includes:

(1) Robust operational performance (2) Extended spatial coverage (3) Extended temporal coverage (4) Increased confidence (5) Improved ambiguity (6) Improved detection performance (7) Enhanced spatial resolution (8) Improved system operational reliability In the preferred smart machine gun application of the present invention, referring to FIG. 2, the user identifies the coordinates of a target by the use of the target coordinate producer 8, including a radar and laser rangefinder. The coordinates of a target are electronically relayed to the pointing controller 7 through the visual and voice device 9. The actuator 6, including a machine gunner, slews the gun barrel boresight toward the precise coordinates of the target so that it is ready to start laying down fire. The visual and voice device 9 shows the location of the target and the pointing procedure. After the user selects the target from the display, the target coordinates are automatically relayed to the pointing controller 7, as well as current attitude of the device 1 from the IMU/AHRS 5. The actuator 6 (the machine gunner) interacts with the pointing controller 7 to implement the fire control mission.

The smart machine gun application of the present invention is required to perform its missions in the presence of disturbances, parametric uncertainces and malfunctions, and to account for undesired vibrations. The system of the present invention integrates the techniques of signal/image processing, pattern classification, control system modeling, analysis and synthesis. The system of the present invention balances and optimizes tightly coupled signal processing and control strategies, algorithms and procedures.

Figure 3:
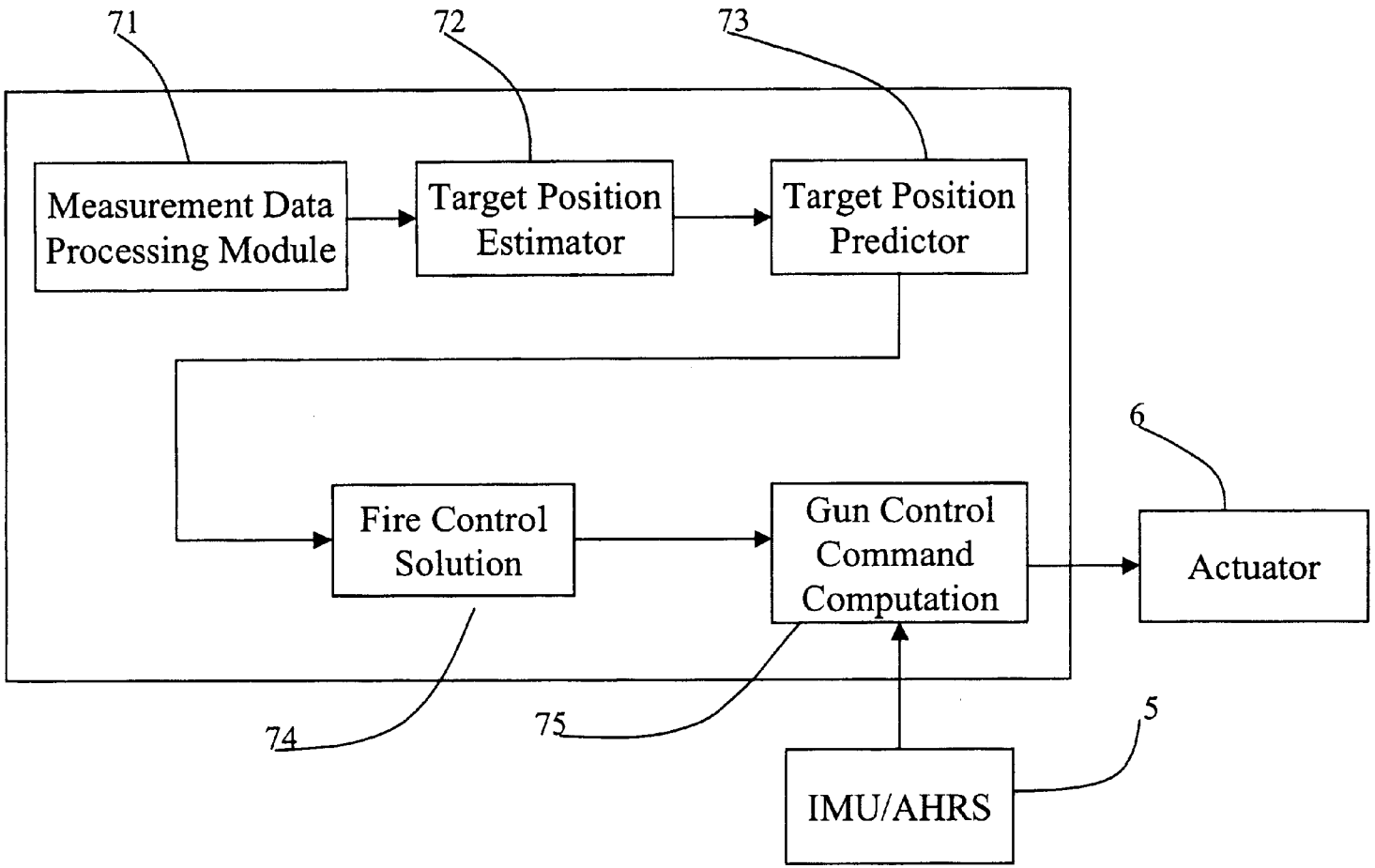
FIG. 3 is a block diagram illustrating the pointing controller in the machine gun application according to the above preferred embodiment of the present invention.

Referring to FIG. 3, the pointing controller 7 further comprises:

- a measurement data processing module 71, for transforming the target positioning measurements, measured by the target coordinate producer 8 and corrupted with measurement noise, from the target coordinate producer body coordinates to local level coordinates;
- a target position estimator 72, for yielding the current target state including target position estimation using the target positioning measurements;
- a target position predictor 73, for predicting the future target trajectory and calculating the interception position and time of a projectile launched by the gun turret and the target;
- a fire control solution module 74, for producing the gun turret azimuth and elevation required for launch of the projectile; and
- a device control command computation module 75, for producing control commands to the actuator 6 using the required gun turret azimuth and elevation and current attitude and attitude rate data of the gun turret 1 from the IMU/AHRS 5 to stabilize and implement the required gun turret azimuth and elevation with disturbance rejection.

Generally, radar measurements include the target range, range rate, azimuth, azimuth rate, elevation and elevation rate. The relationship between the target position and velocity, and the radar measurements can be expressed as:

$$r_m = \sqrt{x_T^2 + y_T^2 + z_T^2} + w_1$$

$$\theta_m = \tan^{-1}\left(\frac{-z_T}{\sqrt{x_T^2 + y_T^2}}\right) + w_2$$

$$\varphi_m = \tan^{-1}\left(\frac{y_T}{x_T}\right) + w_3$$

$$\dot{r}_m = \frac{\dot{x}_T x_T + \dot{y}_T y_T + \dot{z}_T z_T}{\sqrt{x_T^2 + y_T^2 + z_T^2}} + w_4$$

$$\dot{\theta}_m = \frac{z(\dot{x}_T x_T + \dot{y}_T y_T) - \dot{z}(x_T^2 + y_T^2)}{(x_T^2 + y_T^2 + z_T^2)\sqrt{x_T^2 + y_T^2}} + w_5$$

-continued $$\dot{\varphi}_m = \frac{\dot{y}_T x_T - \dot{x}_T y_T}{x_T^2 + y_T^2} + w_6$$

where $(x_T, y_T, z_T)$ real target position;

$(\dot{x}_T, \dot{y}_T, \dot{z}_T)$=real target velocity;

$(r_m, \dot{r}_m)$=measured target line of sight(LOS) range and range rate;

$(\theta_m, \dot{\theta}_m)$=measured target LOS elevation and elevation rate;

$(\phi_m, \dot{\phi}_m)$=measured target LOS azimuth and azimuth rate;

The radar measurements are expressed in radar antenna coordinates. The target position estimator 72 is embodied as a Kalman filter 72. In order to simplify the software design of the Kalman filter 72, the radar measurements are transferred back into local level orthogonal coordinates. The measurement data processing module 71 maps nonlinearly the radar measurements presented in radar antenna coordinates into those presented in the local level orthogonal coordinates. The relationship between the input and output of the measurement data processing module 71 are:

$$x_{mT} = r_m \cos(\theta_m)\cos(\phi_m)$$

$$y_{mT} = r_m \cos(\theta_m)\sin(\phi_m)$$

$$z_{mT} = r_m \sin(\phi_m)$$

$$\dot{x}_{mT} = \dot{r}_m \cos(\theta_m)\cos(\phi_m) - r_m \sin(\theta_m)\cos(\phi_m)\dot{\theta}_m - r_m \cos(\theta_m)\sin(\phi_m)\dot{\phi}_m$$

$$\dot{y}_{mT} = \dot{r}_m \cos(\theta_m)\sin(\phi_m) - r_m \cos(\theta_m)\sin(\phi_m)\dot{\theta}_m + r_m \cos(\theta_m)\cos(\phi_m)\dot{\phi}_m$$

$$\dot{z}_{mT} = -\dot{r}_m \sin\theta_m) - r_m \cos(\theta_m)\dot{\phi}_m$$

where $(x_{mT}, y_{mT}, z_{mT})$=transformed target position measurement;

$(\dot{x}_{mT}, \dot{y}_{mT}, \dot{z}_{mT})$=transformed target velocity;

For a successful engagement, the future target trajectory needs to be predicted accurately. Then the intercept position and time can be solved rapidly in terms of predicted target trajectory and the projectile flight dynamics. The inputs to the target position predictor 73 are the currently estimated target states, including target position and velocity, from the target position estimator 72, while the outputs the target position predictor 73 are the predicted intercept and intercept time.

Figure 4:
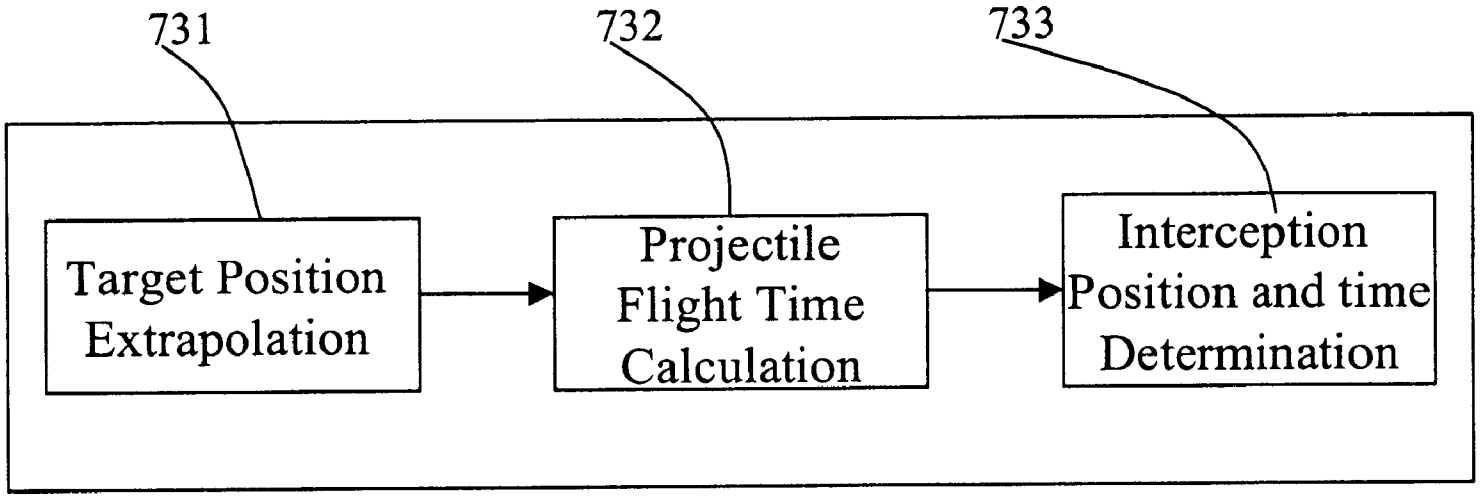
FIG. 4 is a block diagram illustrating the target position predictor according to the above preferred embodiment of the present invention.

Referring to FIG. 4, the target position predictor 73 further comprises a target position extrapolation module 731, a projectile flight time calculation 732, and an interception position and time determination 733.

The target position extrapolation module 731 is adapted for extrapolating the future trajectory of the projectile using the current target state including the target position estimation and system dynamic matrix:

$$X(t_{k+j}) = \Phi X(t_{k+j-1})$$

where $X(t_k)$ is the current target state estimates from the target position estimator 72. $X(t_{k+j})$ is predicted target state vector at time $t_{k+j} = t_k + \delta t * j$, where $\delta t$ is chosen much less than the Kalman filtering step $\delta T = t_{k+1} - t_k$.

The projectile flight time calculation module 732 is adapted for computing the time of the projectile to fly from the gun turret to the interception position. As a preliminary design of the projectile flight time calculation module 732, the projectile flight time is approximately calculated by the LOS distance divided by a constant projectile speed.

The interception position and time determination module 733 is adapted for computing the interception position and time using the predicted future projectile trajectory and projectile flight time. Once the predicted target trajectory is determined, the time $t_1$ for the projectile to fly from the gun turret to each point of the predicted target trajectory and the time $t_2$ for the target to fly to the point can be calculated. Then the interception position can be determined, since for the interception point, the time $t_1$ should be equal to the time $t_2$.

The fire control solution module 74 gives the required gun turret azimuth and elevation by means of the given interception time and position from the target position predictor 72. Once the interception position is known, the gun tip elevation and azimuth can be accurately determined by using the fire control solution algorithms. The desired device tip azimuth $\phi^d_{gun}$ and elevation $\theta^d_{gun}$ are calculated by $$\varphi^d_{gun} = \tan^{-1}\left(\frac{y_{Tp}}{x_{Tp}}\right)$$

$$\theta^d_{gun} = \tan^{-1}\left(\frac{-z_{Tp}}{\sqrt{x^2_{Tp} + y^2_{Tp}}}\right)$$

where $(x_{mT}, y_{mT}, z_{mT})$=the predicted interception position.

The device control command computation module 75 computes the rotation commands to the actuator 6 using the desired device tip azimuth and the elevation from the fire control solution module and the current attitude and attitude rate data from the IMU/AHRS 5 to place the gun tip to the desired position and stabilize the gun tip at the desired position with any disturbance rejection.

The device control command computation module 75 is a digital controller and definitely essential to isolate the gun turret from vibrations while maintaining precision stabilization and pointing performance.

As a preferred embodiment of the visual and voice device 9, the visual and voice device 9 is designed to display the target of the field of view of the gun turret motion, the projectile and target flight trajectories during the interception process.

Referring to FIGS. 1 to 4, the pointing and stabilization method according to the above preferred embodiment of the present invention comprises the steps of:

(1) identifying a desired pointing direction of a device by providing coordinates of a target by a means, including a target coordinate producer 8;

(2) determining a current attitude measurement of the device by a means, including an inertial measurement unit;

(3) computing rotation commands of the device using the desired pointing direction of the device and the current attitude measurements of the device by a means, including a pointing controller 7;

(4) rotating the device to the desired pointing direction by a means, including an actuator 6.

(5) illustrating the targets and desired pointing direction and current direction of the device; and (6) producing a voice representing the pointing procedure.

According to the preferred embodiment of the present invention, the step (3) further comprises the steps of, 3.1 transforming the target positioning measurements, measured by the target coordinate producer 8 and corrupted with measurement noise, from the target coordinate producer body coordinates to local level coordinates;

3.2 yielding the current target state including target position estimation using target positioning measurements measured by the target coordinate producer 8;

3.3 predicting the future target trajectory and calculating interception position and time of a projectile launched by the gun turret and the target;

3.4 producing gun turret azimuth and elevation required for launch of the projectile; and 3.5 producing control commands to the actuator using the gun turret azimuth and elevation and the current attitude and attitude rate data of the gun turret from the IMU/AHRS to stabilize and implement the gun turret azimuth and elevation with disturbance rejection.

Also, the step (3.3) further comprises the steps of:

3.3.1 extrapolating the future trajectory of the projectile using the current target state, including the current target position estimation and system dynamic matrix;

3.3.2 computing time of the projectile to fly from the gun turret to interception position; and 3.3.3 computing interception position and time using the predicted future projectile trajectory and projectile flight time.

The preferred IMU/AHRS 5 is a micro MEMS IMU in which a position and attitude processor is built in. The IMU/AHRS 5 is disclosed as follows.

Generally, an inertial measurement unit (IMU) is employed to determine the motion of a carrier. In principle, an inertial measurement unit relies on three orthogonally mounted inertial angular rate producers and three orthogonally mounted acceleration producers to obtain three-axis angular rate and acceleration measurement signals. The three orthogonally mounted inertial angular rate producers and three orthogonally mounted acceleration producers with additional supporting mechanical structure and electronic devices are conventionally called an Inertial Measurement Unit (IMU). The conventional IMUs may be cataloged into Platform IMU and Strapdown IMU.

In the platform IMU, angular rate producers and acceleration producers are installed on a stabilized platform. Attitude measurements can be directly picked off from the platform structure. But attitude rate measurements can not be directly obtained from the platform. Moreover, there are highly accurate feedback control loops associated with the platform.

Compared with the platform IMU, in the strapdown IMU, angular rate producers and acceleration producers are directly strapped down with the carrier and move with the carrier. The output signals of the strapdown rate producers and acceleration producers are expressed in the carrier body frame. The attitude and attitude rate measurements can be obtained by means of a series of computations.

A conventional IMU uses a variety of inertial angular rate producers and acceleration producers. Conventional inertial angular rate producers include iron spinning wheel gyros and optical gyros, such as Floated Integrating Gyros (FIG), Dynamically Tuned Gyros (DTG), Ring Laser Gyros (RLG), Fiber-Optic Gyros (FOG), Electrostatic Gyros (ESG), Josephson Junction Gyros (JJG), Hemisperical Resonating Gyros (HRG), etc. Conventional acceleration producers include Pulsed Integrating Pendulous Accelerometer (PIPA), Pendulous Integrating Gyro Accelerometer (PIGA), etc.

The processing method, mechanical supporting structures, and electronic circuitry of conventional IMUs vary with the type of gyros and accelerometers employed in the IMUs. Because conventional gyros and accelerometers have a large size, high power consumption, and moving mass, complex feedback control loops are required to obtain stable motion measurements. For example, dynamic-tuned gyros and accelerometers need force-rebalance loops to create a moving mass idle position. There are often pulse modulation force-rebalance circuits associated with dynamic-tuned gyros and accelerometer based IMUs. Therefore, conventional IMUs commonly have the following features:

1. High cost,
2. Large bulk (volume, mass, large weight),
3. High power consumption,
4. Limited lifetime, and
5. Long turn-on time.

These present deficiencies of conventional IMUs prohibit them from use in the emerging commercial applications, such as, phased array antennas for mobile communications, automotive navigation, and handheld equipment.

New horizons are opening up for inertial sensor device technologies. MEMS (MicroElectronicMechanicalSystem) inertial sensors offer tremendous cost, size, and reliability improvements for guidance, navigation, and control systems, compared with conventional inertial sensors.

MEMS, or, as stated more simply, micromachines, are considered as the next logical step in the silicon revolution. It is believed that this coming step will be different, and more important than simply packing more transistors onto silicon. The hallmark of the next thirty years of the silicon revolution will be the incorporation of new types of functionality onto the chip structures, which will enable the chip to, not only think, but to sense, act, and communicate as well.

Prolific MEMS angular rate sensor approaches have been developed to meet the need for inexpensive yet reliable angular rate sensors in fields ranging from automotive to consumer electronics. Single input axis MEMS angular rate sensors are based on either translational resonance, such as tuning forks, or structural mode resonance, such as vibrating rings. Moreover, dual input axis MEMS angular rate sensors may be based on angular resonance of a rotating rigid rotor suspended by torsional springs. Current MEMS angular rate sensors are primarily based on an electronically-driven tuning fork method.

More accurate MEMS accelerometers are the force rebalance type that use closed-loop capacitive sensing and electrostatic forcing. Draper's micromechnical accelerometer is a typical example, where the accelerometer is a monolithic silicon structure consisting of a torsional pendulum with capacitive readout and electrostatic torquer. Analog Device's MEMS accelerometer has an integrated polysilicon capacitive structure fabricated with on-chip BIMOS process to include a precision voltage reference, local oscillators, amplifiers, demodulators, force rebalance loop and self-test functions.

Although the MEMS angular rate sensors and MEMS accelerometers are available commercially and have achieved micro chip-size and low power consumption, however, there is not yet available high performance, small size, and low power consumption IMUs.

Currently, MEMS exploits the existing microelectronics infrastructure to create complex machines with micron feature sizes. These machines can have many functions, including sensing, communication, and actuation. Extensive applications for these devices exist in a wide variety of commercial systems.

The difficulties for building a micro IMU is the achievement of the following hallmark using existing low cost and low accuracy angular rate sensors and accelerometers:

1. Lowcost,
2. Micro size
3. Lightweight
4. Low power consumption
5. No wear/extended lifetime
6. Instant turn-on
7. Large dynamic range
8. High sensitivity
9. High stability
10. High accuracy To achieve the high degree of performance mentioned above, a number of problems need to be addressed:

(1) Micro-size angular rate sensors and accelerometers need to be obtained. Currently, the best candidate angular rate sensor and accelerometer to meet the micro size are MEMS angular rate sensors and MEMS accelerometers.

(2) Associated mechanical structures need to be designed.

(3) Associated electronic circuitry needs to be designed.

(4) Associated thermal requirements design need to be met to compensate the MEMS sensor's thermal effects.

(5) The size and power of the associated electronic circuitry needs to be reduced.

The micro inertial measurement unit of the present invention is preferred to employ with the angular rate producer, such as MEMS angular rate device array or gyro array, that provides three-axis angular rate measurement signals of a carrier, and the acceleration producer, such as MEMS acceleration device array or accelerometer array, that provides three-axis acceleration measurement signals of the carrier, wherein the motion measurements of the carrier, such as attitude and heading angles, are achieved by means of processing procedures of the three-axis angular rate measurement signals from the angular rate producer and the three-axis acceleration measurement signals from the acceleration producer.

In the present invention, output signals of the angular rate producer and acceleration producer are processed to obtain digital highly accurate angular rate increment and velocity increment measurements of the carrier, and are further processed to obtain highly accurate position, velocity, attitude and heading measurements of the carrier under dynamic environments.

Figure 5:
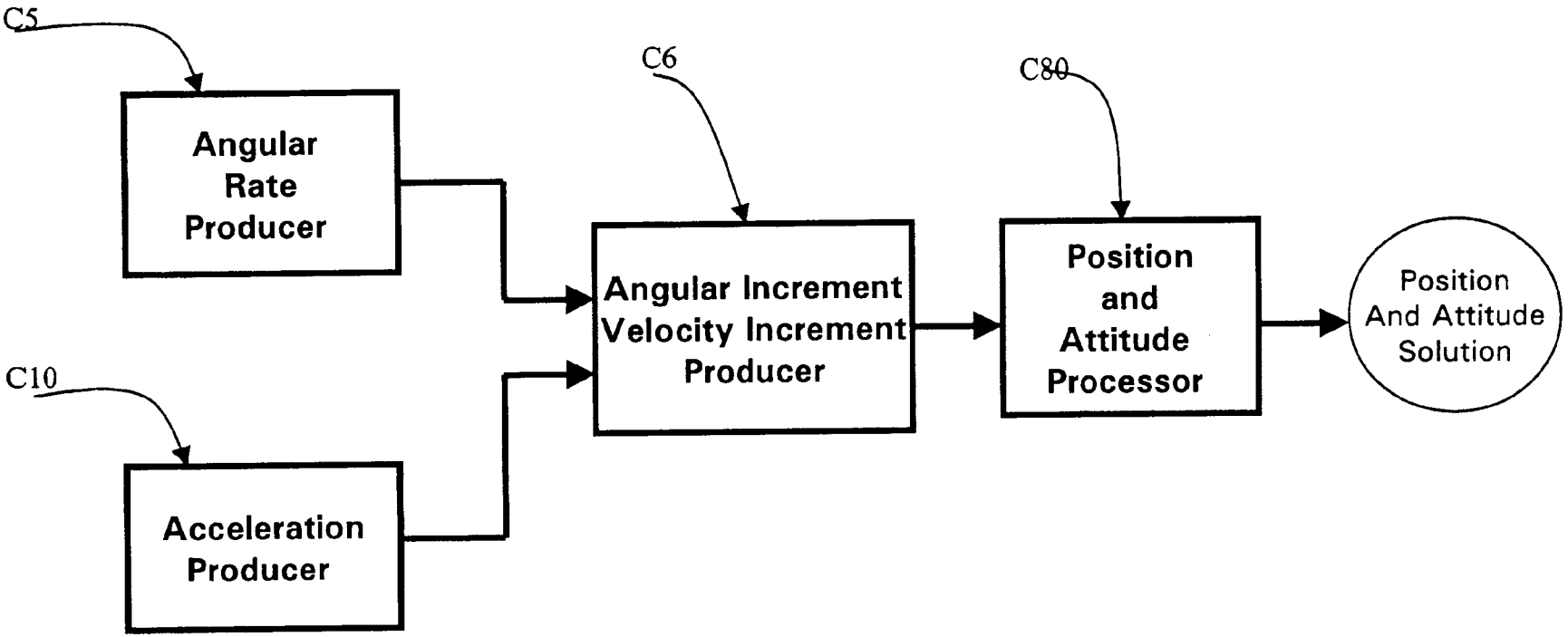
FIG. 5 is a block diagram illustrating the processing module for a micro inertial measurement unit according to a preferred embodiment of the present invention.

Referring to FIG. 5, the micro inertial measurement unit of the present invention comprises an angular rate producer c5 for producing three-axis (X axis, Y axis and Z axis) angular rate signals; an acceleration producer c10 for producing three-axis (X-axis, Y axis and Z axis) acceleration signals; and an angular increment and velocity increment producer c6 for converting the three-axis angular rate signals into digital angular increments and for converting the input three-axis acceleration signals into digital velocity increments.

Moreover, a position and attitude processor c80 is adapted to further connect with the micro IMU of the present invention to compute position, attitude and heading angle measurements using the three-axis digital angular increments and three-axis velocity increments to provide a user with a rich motion measurement to meet diverse needs.

The position, attitude and heading processor c80 further comprises two optional running modules:

(1) Attitude and Heading Module c81, producing attitude and heading angle only; and (2) Position, Velocity, Attitude, and Heading Module c82, producing position, velocity, and attitude angles.

In general, the angular rate producer c5 and the acceleration producer c10 are very sensitive to a variety of temperature environments. In order to improve measurement accuracy, referring to FIG. 6, the present invention further comprises a thermal controlling means for maintaining a predetermined operating temperature of the angular rate producer c5, the acceleration producer c10 and the angular increment and velocity increment producer c6. It is worth to mention that if the angular rate producer c5, the acceleration producer c10 and the angular increment and velocity increment producer c6 are operated in an environment under prefect and constant thermal control, the thermal controlling means can be omitted.

Figure 12:
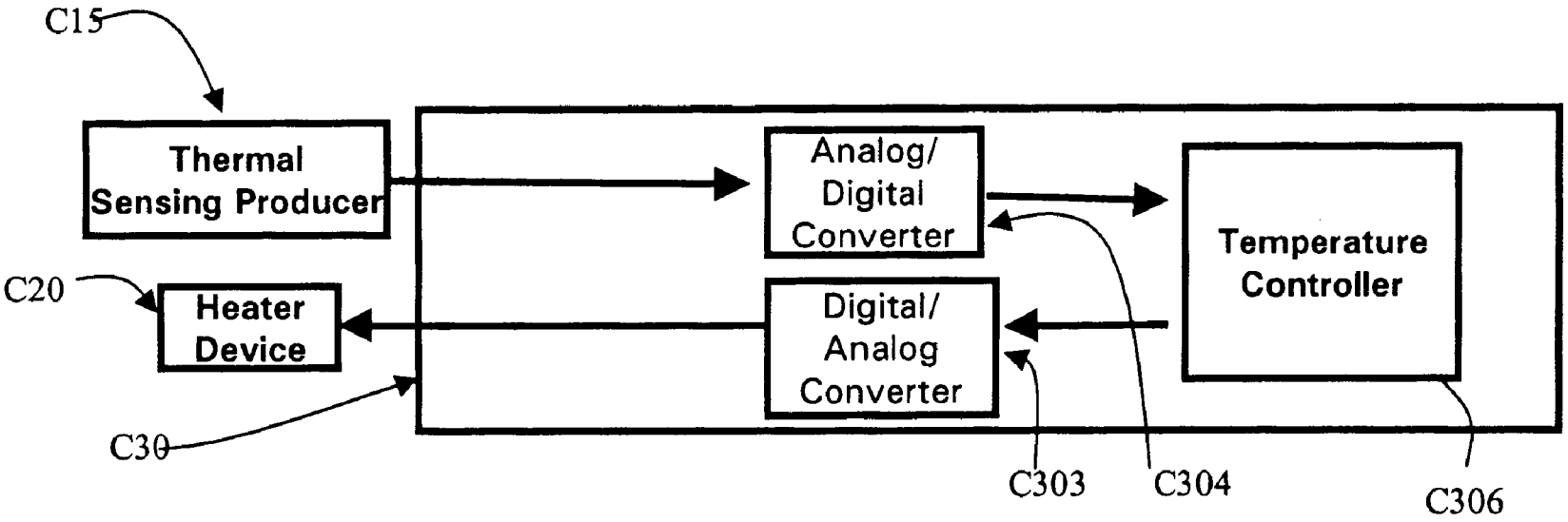
FIG. 12 is a block diagram illustrating a thermal processor for outputting analog voltage signals of the thermal sensing producer according to the above preferred embodiment of the present invention.

According to the preferred embodiment of the present invention, as shown in FIG. 12, the thermal controlling means comprises a thermal sensing producer device c15, a heater device c20 and a thermal processor c30.

The thermal sensing producer device c15, which produces temperature signals, is processed in parallel with the angular rate producer c5 and the acceleration producer c10 for maintaining a predetermined operating temperature of the angular rate producer c5 and the acceleration producer c10 and angular increment and velocity increment producer c6 of the micro IMU, wherein the predetermined operating temperature is a constant designated temperature selected between 150° F. and 185° F., preferable 176° F. (±0.1° F.).

The temperature signals produced from the thermal sensing producer device c15 are input to the thermal processor c30 for computing temperature control commands using the temperature signals, a temperature scale factor, and a predetermined operating temperature of the angular rate producer c5 and the acceleration producer c10, and produce driving signals to the heater device c20 using the temperature control commands for controlling the heater device c20 to provide adequate heat for maintaining the predetermined operating temperature in the micro IMU.

Temperature characteristic parameters of the angular rate producer c5 and the acceleration producer c10 can be determined during a series of the angular rate producer and acceleration producer temperature characteristic calibrations.

Figure 7:
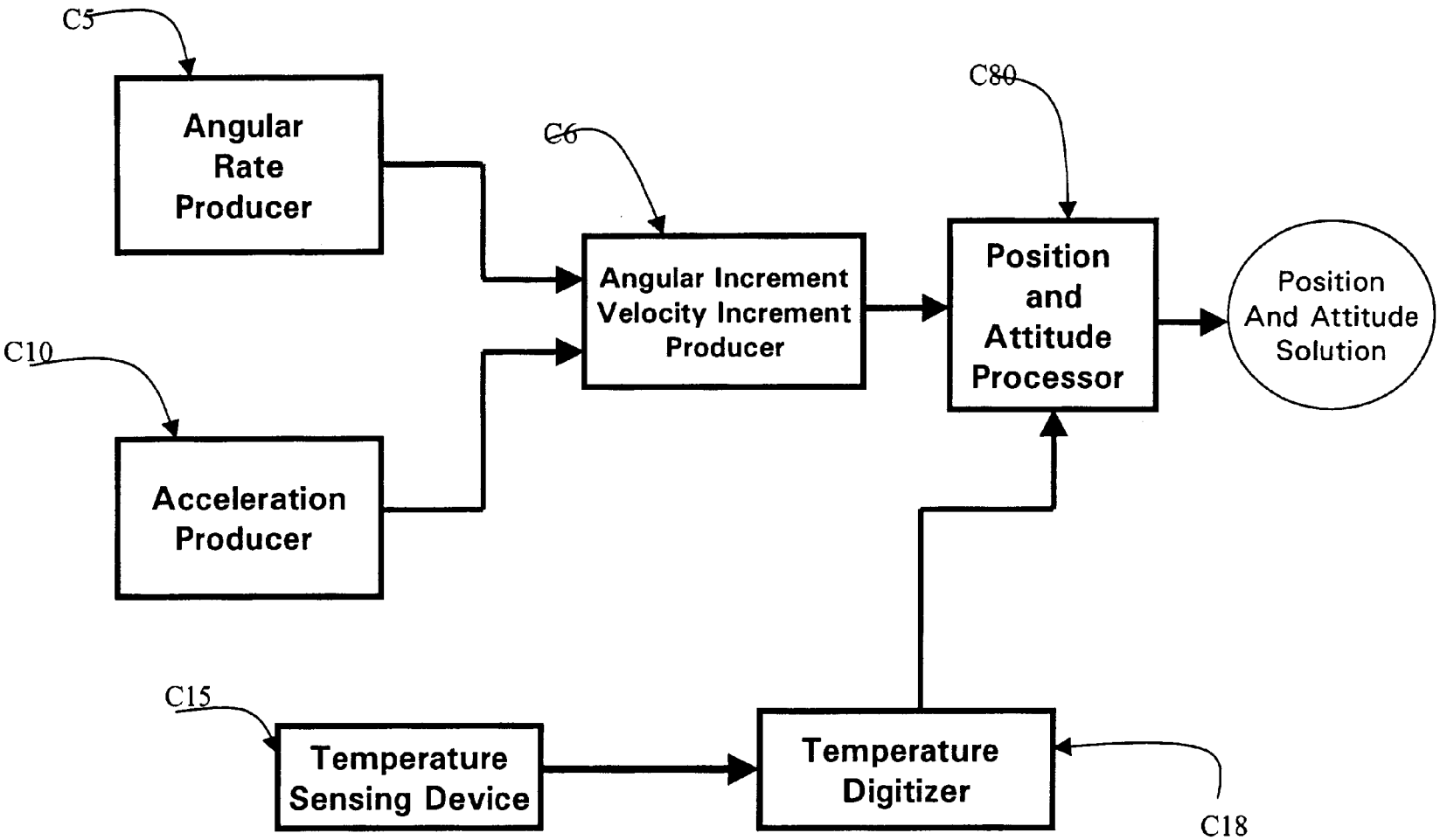
FIG. 7 is a block diagram illustrating the processing modules with thermal compensation processing for the micro inertial measurement unit according to the above preferred embodiment of the present invention.
Figure 16:
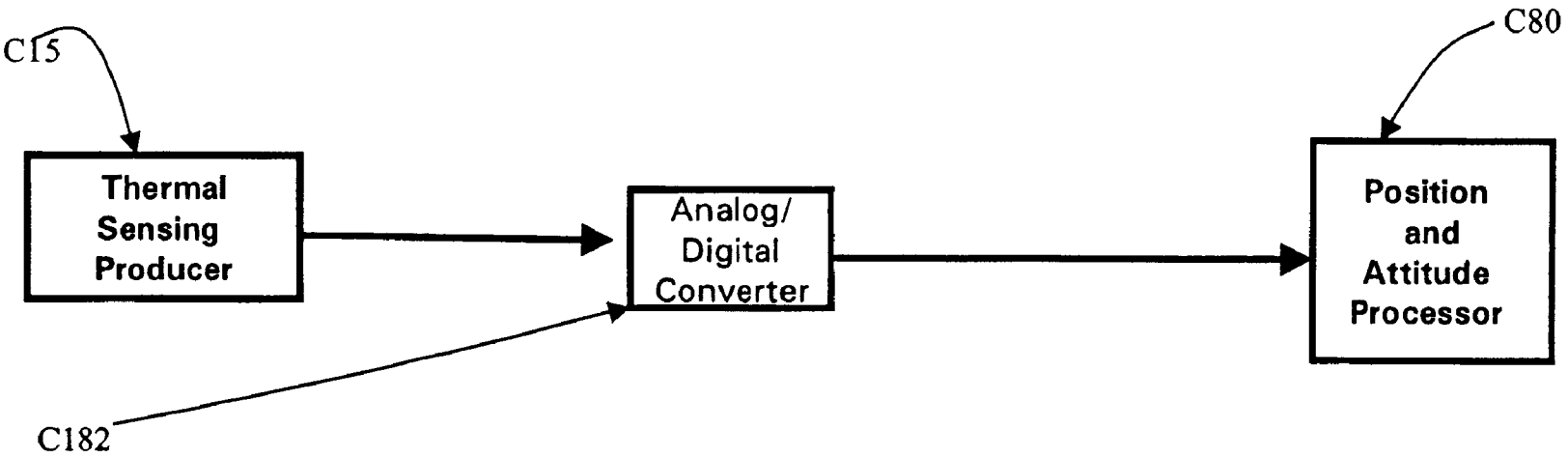
FIG. 16 is a block diagram illustrating a temperature digitizer for outputting analog voltage signals of the thermal sensing producer according to the above preferred embodiment of the present invention.

Referring to FIG. 7, when the above thermal processor c30 and the heater device c20 are not provided, in order to compensate the angular rate producer and acceleration producer measurement errors induced by a variety of temperature environments, the micro IMU of the present invention can alternatively comprise a temperature digitizer c18 for receiving the temperature signals produced from the thermal sensing producer device c15 and outputting a digital temperature value to the position, attitude, and heading processor c80. As shown in FIG. 16, the temperature digitizer c18 can be embodied to comprise an analog/digital converter c182.

Moreover, the position, attitude, and heading processor c80 is adapted for accessing temperature characteristic parameters of the angular rate producer and the acceleration producer using a current temperature of the angular rate producer and the acceleration producer from the temperature digitizer c18, and compensating the errors induced by thermal effects in the input digital angular and velocity increments and computing attitude and heading angle measurements using the three-axis digital angular increments and three-axis velocity increments in the attitude and heading processor c80.

In most applications, the output of the angular rate producer c5 and the acceleration producer c10 are analog voltage signals. The three-axis analog angular rate voltage signals produced from the angular producer c5 are directly proportional to carrier angular rates, and the three-axis analog acceleration voltage signals produced from the acceleration producer c10 are directly proportional to carrier accelerations.

Figure 9:
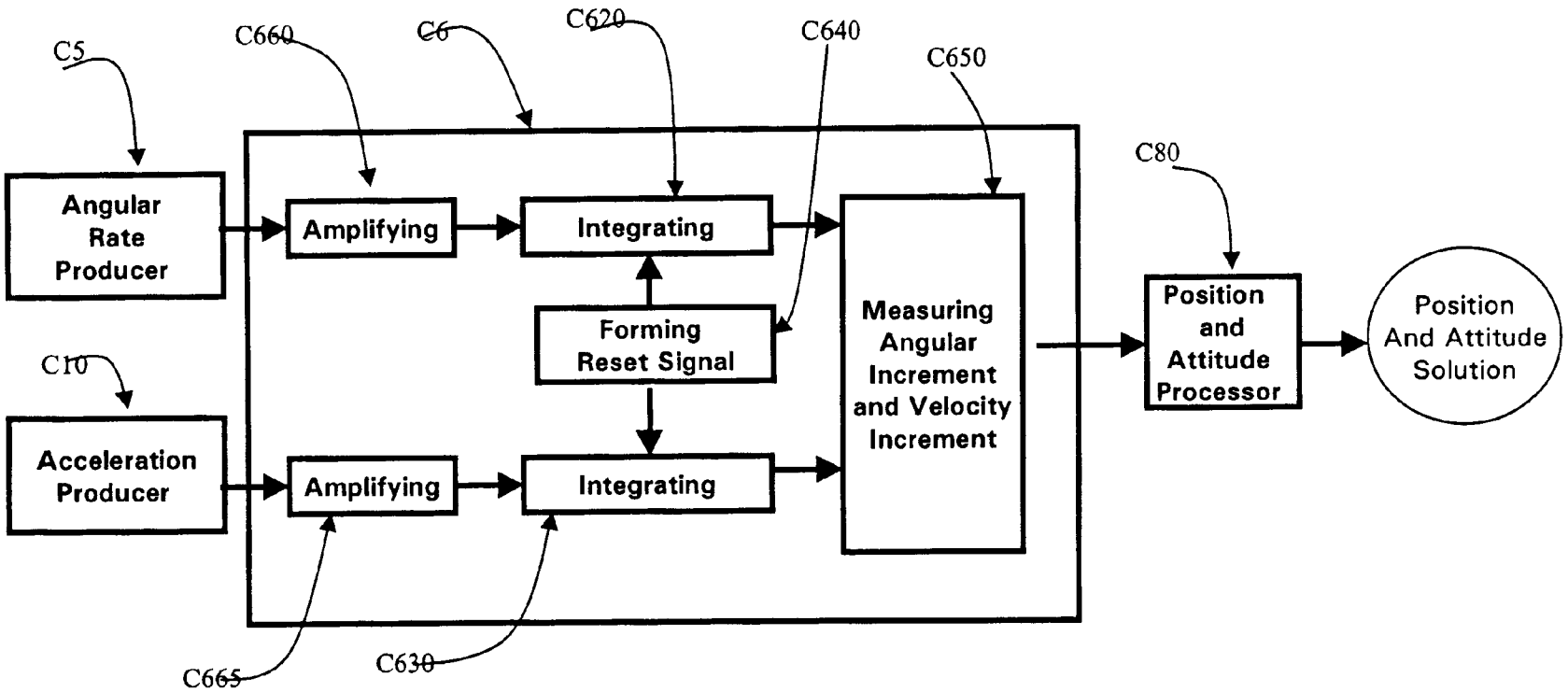
FIG. 9 is a block diagram illustrating another angular increment and velocity increment producer for outputting voltage signals of angular rate producer and acceleration producer for the micro inertial measurement unit according to the above preferred embodiment of the present invention.
Figure 10:
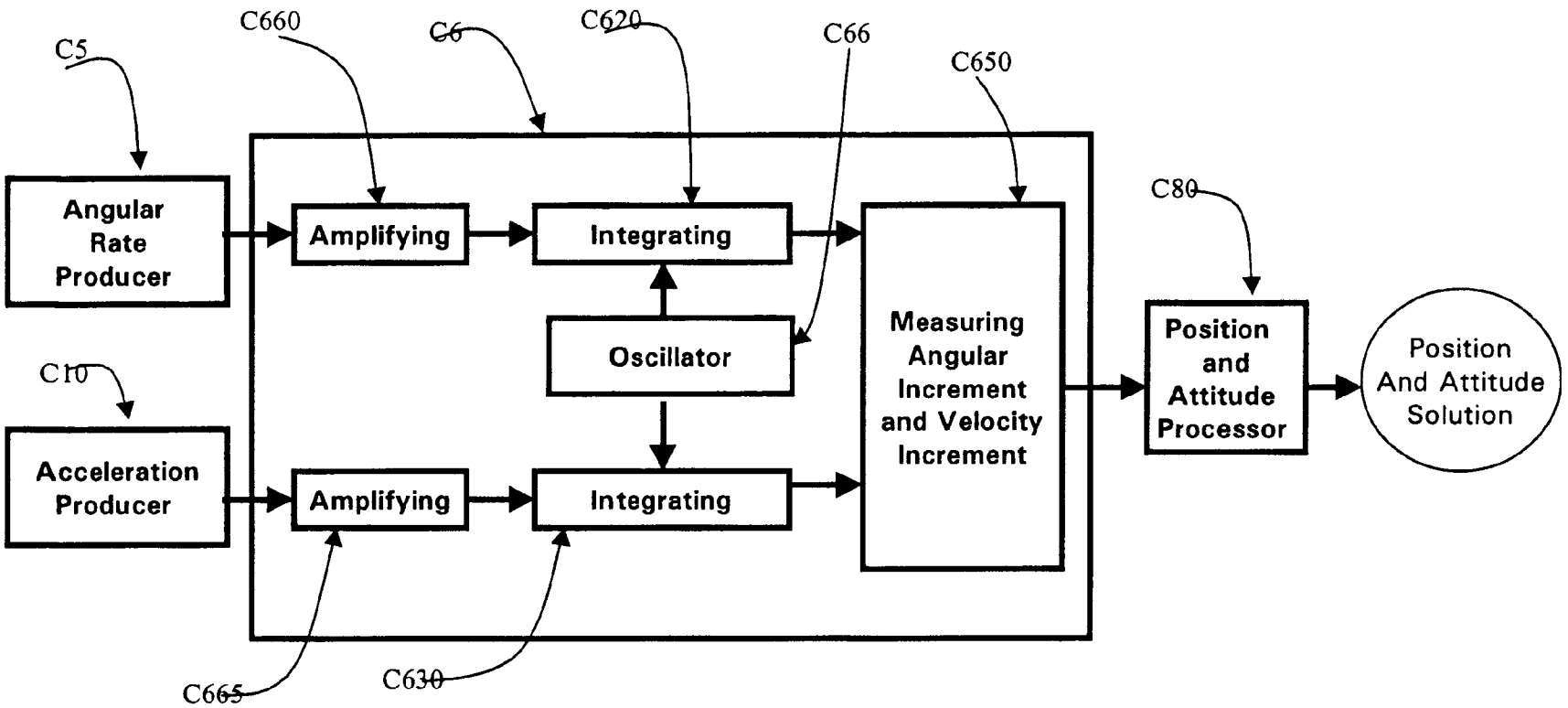
FIG. 10 is a block diagram illustrating another angular increment and velocity increment producer for outputting voltage signals of an angular rate producer and acceleration producer for the micro inertial measurement unit according to the above preferred embodiment of the present invention.

When the outputting analog voltage signals of the angular rate producer c5 and the acceleration producer c10 are too weak for the angular increment and velocity increment producer c6 to read, the angular increment and velocity increment producer c6 may employ amplifying means c660 and c665 for amplifying the analog voltage signals input from the angular rate producer c5 and the acceleration producer c10 and suppress noise signals residing within the analog voltage signals input from the angular rate producer c5 and the acceleration producer c10, as shown in FIGS. 9 and 10.

Figure 8:
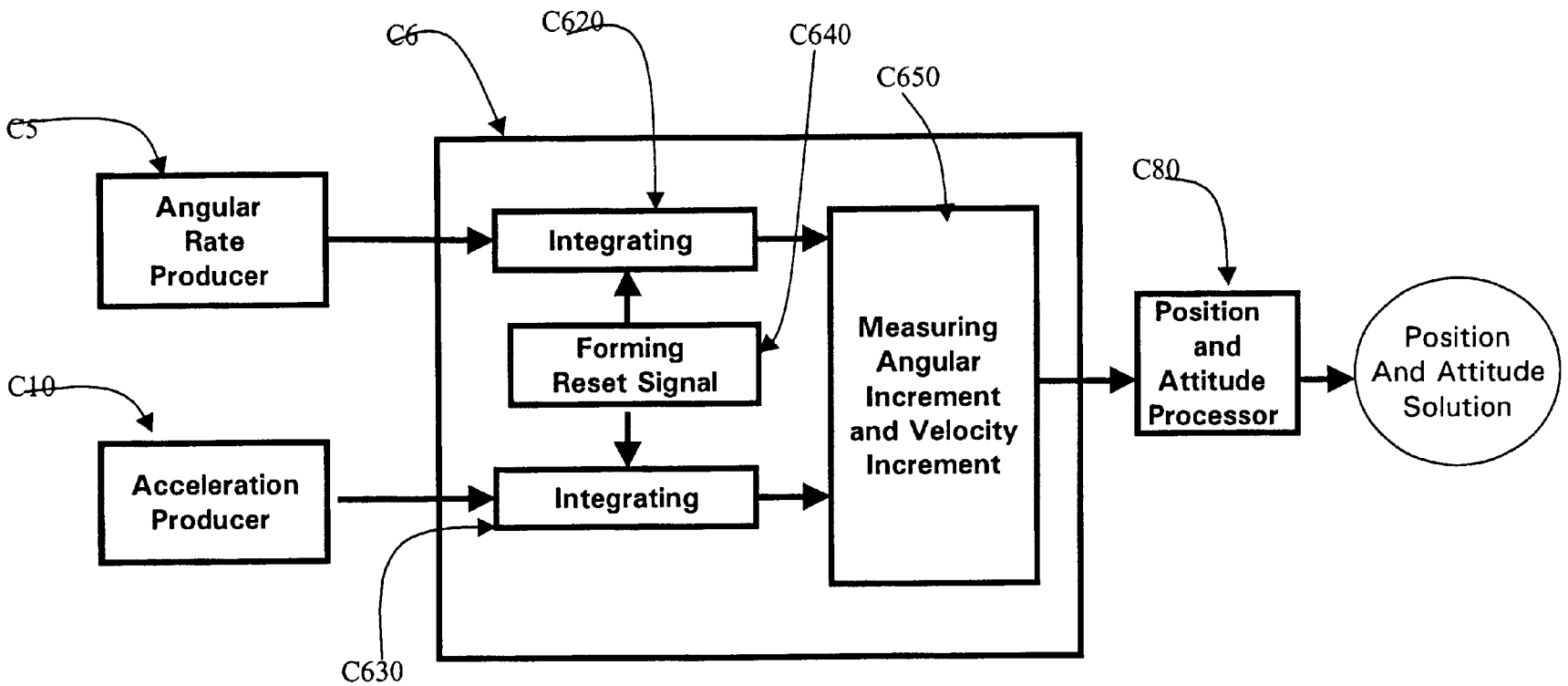
FIG. 8 is a block diagram illustrating an angular increment and velocity increment producer for outputting voltage signals of the angular rate producer and acceleration producer for the micro inertial measurement unit according to the above preferred embodiment of the present invention.

Referring to FIG. 8, the angular increment and velocity increment producer c6 comprises an angular integrating means c620, an acceleration integrating means c630, a resetting means c640, and an angular increment and velocity increment measurement means c650.

The angular integrating means c620 and the acceleration integrating means c630 are adapted for respectively integrating the three-axis analog angular rate voltage signals and the three-axis analog acceleration voltage signals for a predetermined time interval to accumulate the three-axis analog angular rate voltage signals and the three-axis analog acceleration voltage signals as an uncompensated-three-axis angular increment and an uncompensated three-axis velocity increment for the predetermined time interval to achieve accumulated angular increments and accumulated velocity increments. The integration is performed to remove noise signals that are non-directly proportional to the carrier angular rate and acceleration within the three-axis analog angular rate voltage signals and the three-axis analog acceleration voltage signals, to improve the signal-to-noise ratio, and to remove the high frequency signals in the three-axis analog angular rate voltage signals and the three-axis analog acceleration voltage signals. The signals are directly proportional to the carrier angular rate and acceleration within the three-axis analog angular rate voltage signals and the three-axis analog acceleration voltage signals.

The resetting means forms an angular reset voltage pulse and a velocity reset voltage pulse as an angular scale and a velocity scale which are input into the angular integrating means c620 and the acceleration integrating means c630 respectively.

The angular increment and velocity increment measurement means c650 is adapted for measuring the voltage values of the three-axis accumulated angular increments and the three-axis accumulated velocity increments with the angular reset voltage pulse and the velocity reset voltage pulse respectively to acquire angular increment counts and velocity increment counts as a digital form of the angular increment and velocity increment measurements respectively.

In order to output real three-angular increment and velocity increment values as an optional output format to substitute the voltage values of the three-axis accumulated angular increments and velocity increments, the angular increment and velocity increment measurement means c650 also scales the voltage values of the three-axis accumulated angular and velocity increments into real three-axis angular and velocity increment voltage values.

In the angular integrating means c620 and the acceleration integrating means c630, the three-axis analog angular voltage signals and the three-axis analog acceleration voltage signals are each reset to accumulate from a zero value at an initial point of every predetermined time interval.

As shown in FIG. 10, in general, the resetting means c640 can be an oscillator c66, so that the angular reset voltage pulse and the velocity reset voltage pulse are implemented by producing a timing pulse by the oscillator c66. In applications, the oscillator c66 can be built with circuits, such as Application Specific Integrated Circuits (ASIC) chip and a printed circuit board.

Figure 11:
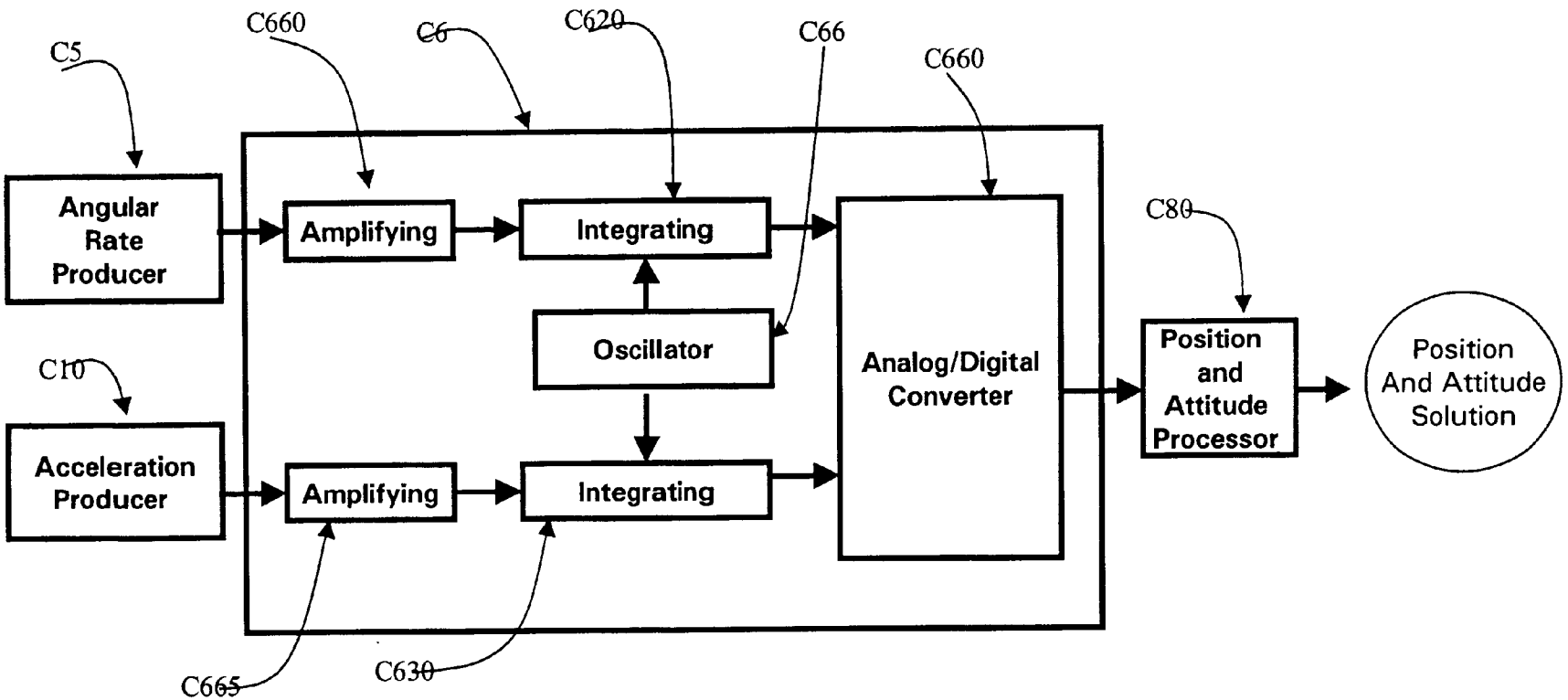
FIG. 11 is a block diagram illustrating another angular increment and velocity increment producer for outputting voltage signals of an angular rate producer and acceleration producer for the micro inertial measurement unit according to the above preferred embodiment of the present invention.

As shown in FIG. 11, the angular increment and velocity increment measurement means c650, which is adapted for measuring the voltage values of the three-axis accumulated angular and velocity increments, is embodied as an analog/digital converter c650. In other words, the analog/digital converter c650 substantially digitizes the raw three-axis angular increment and velocity increment voltage values into digital three-axis angular increment and velocity increments.

Figure 15:
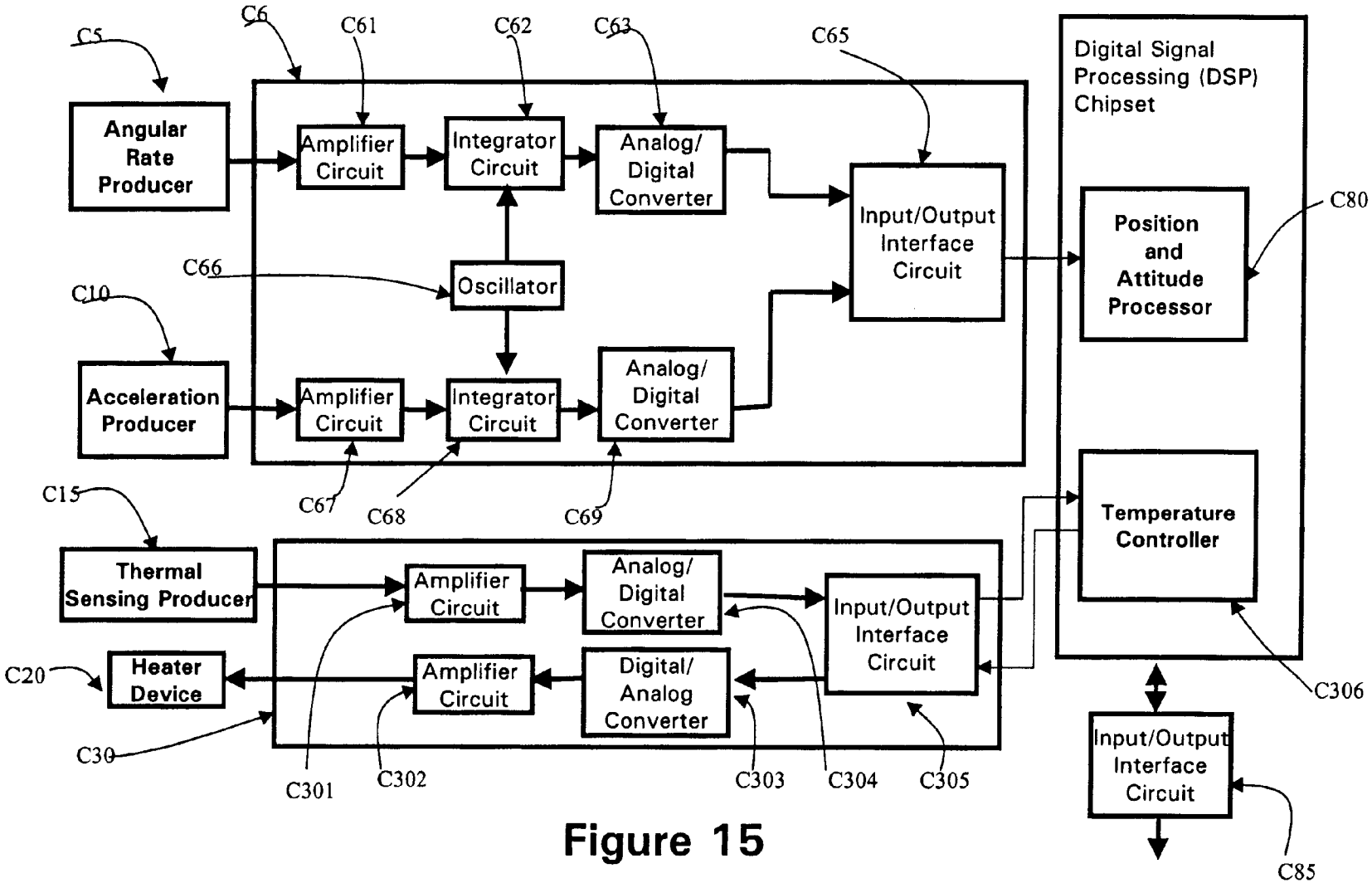
FIG. 15 is a block diagram illustrating a processing module for the micro inertial measurement unit according to the above preferred embodiment of the present invention.
Figure 19:
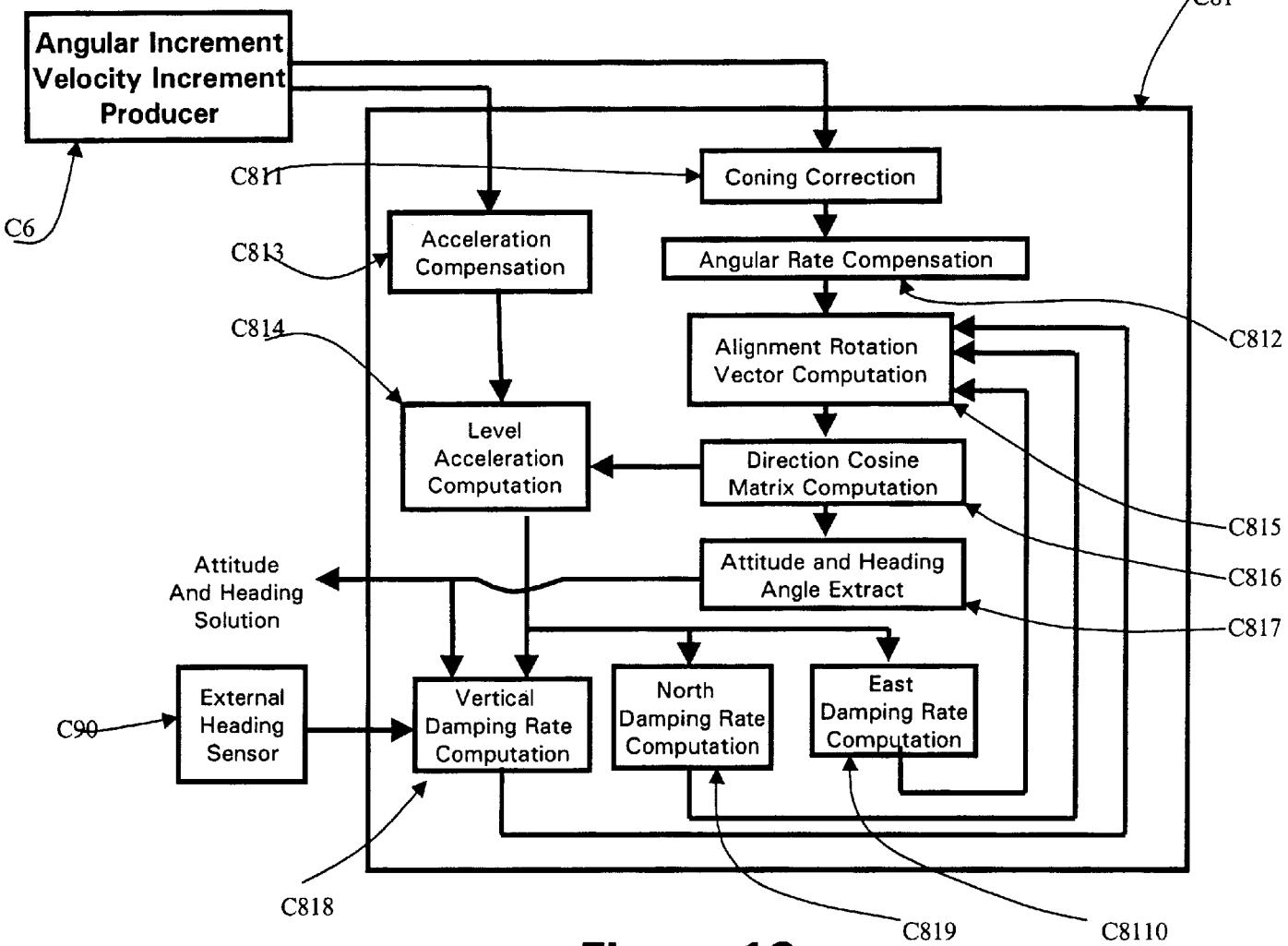
FIG. 19 is a block diagram illustrating the attitude and heading processing module according to the above preferred embodiment of the present invention.

Referring to FIGS. 15 and 19, the amplifying means c660 and c665 of the angular increment and velocity increment producer c6 are embodied by an angular amplifier circuit c61 and an acceleration amplifier circuit c67 respectively to amplify the three-axis analog angular rate voltage signals and the three-axis analog acceleration voltage signals to form amplified three-axis analog angular rate signals and amplified three-axis analog acceleration signals respectively.

The angular integrating means c620 and the acceleration integrating means c630 of the angular increment and velocity increment producer c6 are respectively embodied as an angular integrator circuit c62 and an acceleration integrator circuit c68 for receiving the amplified three-axis analog angular rate signals and the amplified three-axis analog acceleration signals from the angular and acceleration amplifier circuits c61, c67 which are integrated to form the accumulated angular increments and the accumulated velocity increments respectively.

The analog/digital converter c650 of the angular increment and velocity increment producer c6 further includes an angular analog/digital converter c63, a velocity analog/digital converter c69 and an input/output interface circuit c65.

The accumulated angular increments output from the angular integrator circuit c62 and the accumulated velocity increments output from the acceleration integrator circuit are input into the angular analog/digital converter c63 and the velocity analog/digital converter c69 respectively.

The accumulated angular increments are digitized by the angular analog/digital converters c63 by measuring the accumulated angular increments with the angular reset voltage pulse to form digital angular measurements of voltage in terms of the angular increment counts which are output to the input/output interface circuit c65 to generate digital three-axis angular increment voltage values.

The accumulated velocity increments are digitized by the velocity analog/digital converter c69 by measuring the accumulated velocity increments with the velocity reset voltage pulse to form digital velocity measurements of voltage in terms of the velocity increment counts which are output to the input/output interface circuit c65 to generate digital three-axis velocity increment voltage values.

Figure 6:
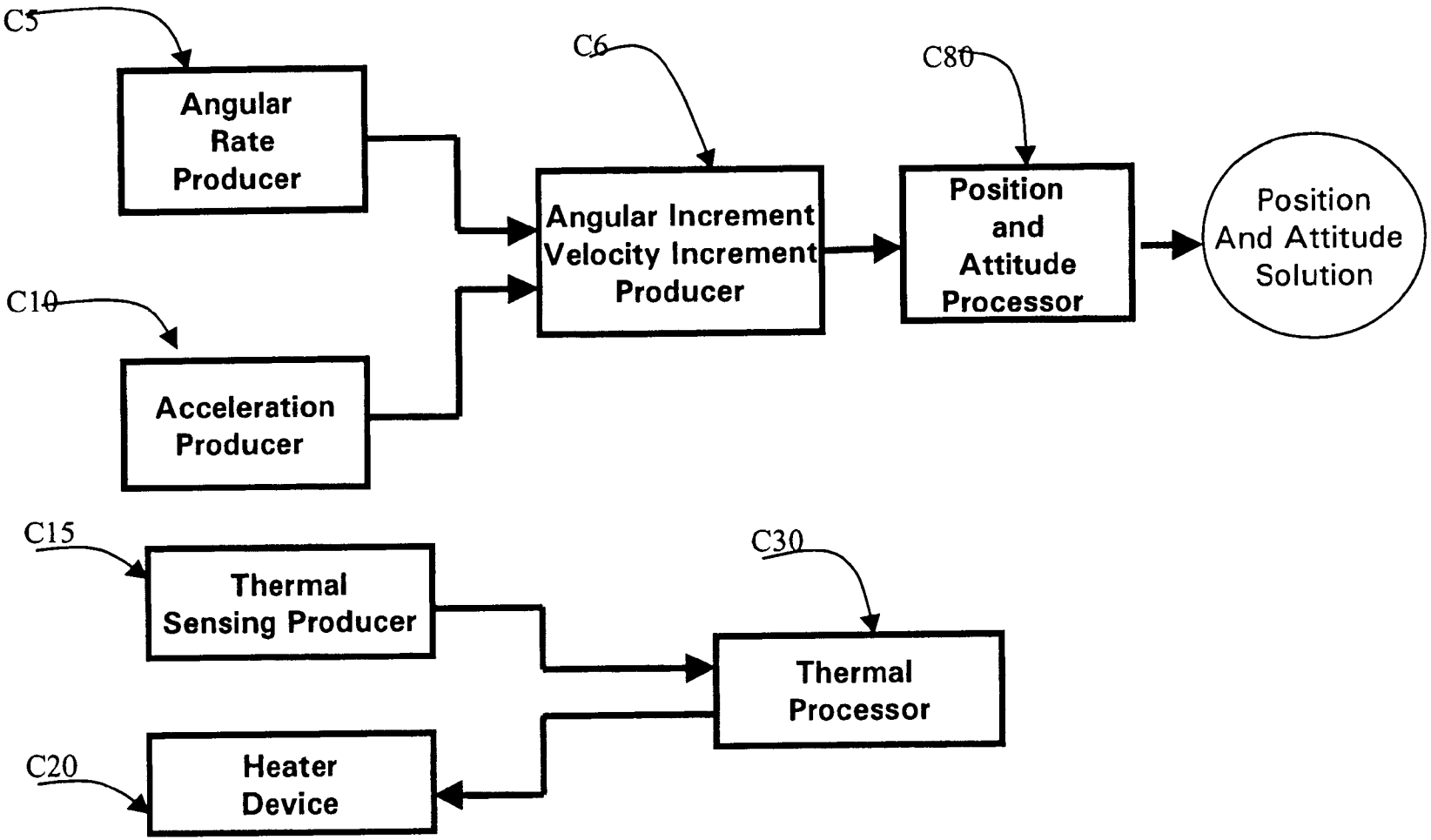
FIG. 6 is a block diagram illustrating the processing modules with thermal control processing for the micro inertial measurement unit according to the above preferred embodiment of the present invention.

Referring to FIGS. 6 and 12, in order to achieve flexible adjustment of the thermal processor c30 for the thermal sensing producer device c15 with analog voltage output and the heater device c20 with analog input, the thermal processor c30 can be implemented in a digital feedback controlling loop as shown in FIG. 12.

The thermal processor c30, as shown in FIG. 12, comprises an analog/digital converter c304 connected to the thermal sensing producer device c15, a digital/analog converter c303 connected to the heater device c20, and a temperature controller c306 connected with both the analog/digital converter c304 and the digital/analog converter c303. The analog/digital converter c304 inputs the temperature voltage signals produced by the thermal sensing producer device c15, wherein the temperature voltage signals are sampled in the analog/digital converter c304 to sampled temperature voltage signals which are further digitized to digital signals and output to the temperature controller c306.

The temperature controller c306 computes digital temperature commands using the input digital signals from the analog/digital converter c304, a temperature sensor scale factor, and a pre-determined operating temperature of the angular rate producer and acceleration producer, wherein the digital temperature commands are fed back to the digital/analog converter c303.

The digital/analog converter c303 converts the digital temperature commands input from the temperature controller c306 into analog signals which are output to the heater device c20 to provide adequate heat for maintaining the predetermined operating temperature of the micro IMU of the present invention.

Figure 13:
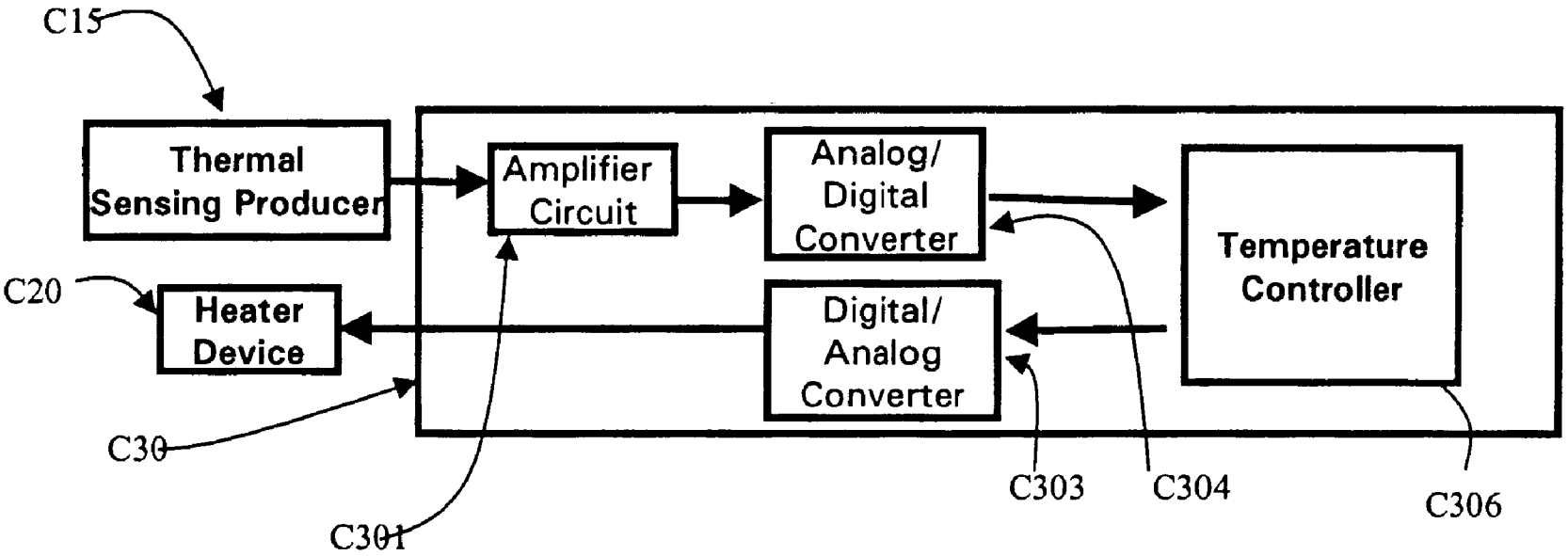
FIG. 13 is a block diagram illustrating another thermal processor for outputting analog voltage signals of the thermal sensing producer according to the above preferred embodiment of the present invention.

Moreover, as shown in FIG. 13, if the voltage signals produced by the thermal sensing producer device c15 are too weak for the analog/digital converter c304 to read, the thermal processor c30 further comprises a first amplifier circuit c301 between the thermal sensing producer device c15 and the digital/analog converter c303, wherein the voltage signals from the thermal sensing producer device c15 is first input into the first amplifier circuit c301 for amplifying the signals and suppressing the noise residing in the voltage signals and improving the signal-to-noise ratio, wherein the amplified voltage signals are then output to the analog/digital converter c304.

The heater device c20 requires a specific driving current signal. In this case, referring to FIG. 14, the thermal processor c30 can further comprise a second amplifier circuit 302 between the digital/analog converter c303 and heater device c20 for amplifying the input analog signals from the digital/analog converter c303 for driving the heater device c20.

In other words, the digital temperature commands input from the temperature controller c306 are converted in the digital/analog converter c303 into analog signals which are then output to the amplifier circuit c302.

Referring to FIG. 15, an input/output interface circuit c305 is required to connect the analog/digital converter c304 and digital/analog converter c303 with the temperature controller c306. In this case, as shown in FIG. 15, the voltage signals are sampled in the analog/digital converter c304 to form sampled voltage signals that are digitized into digital signals. The digital signals are output to the input/output interface circuit c305.

As mentioned above, the temperature controller c306 is adapted to compute the digital temperature commands using the input digital temperature voltage signals from the input/output interface circuit c305, the temperature sensor scale factor, and the pre-determined operating temperature of the angular rate producer and acceleration producer, wherein the digital temperature commands are fed back to the input/output interface circuit c305. Moreover, the digital/analog converter c303 further converts the digital temperature commands input from the input/output interface circuit c305 into analog signals which are output to the heater device c20 to provide adequate heat for maintaining the predetermined operating temperature of the micro IMU.

Referring to FIG. 16, as mentioned above, the thermal processor c30 and the heater device c20 as disclosed in FIGS. 6, 12, 13, 14, and 15 can alternatively be replaced by the analog/digital converter c182 connected to the thermal sensing producer device c15 to receive the analog voltage output from the thermal sensing producer device c15. If the voltage signals produced by the thermal sensing producer device c15 are too weak for the analog/digital converter c182 to read, referring to FIG. 17, an additional amplifier circuit c181 can be connected between the thermal sensing producer device c15 and the digital/analog converter c182 for amplifying the analog voltage signals and suppressing the noise residing in the voltage signals and improving the voltage signal-to-noise ratio, wherein the amplified voltage signals are output to the analog/digital converter c182 and sampled to form sampled voltage signals that are further digitized in the analog/digital converters c182 to form digital signals connected to the attitude and heading processor c80.

Alternatively, an input/output interface circuit c183 can be connected between the analog/digital converter c182 and the attitude and heading processor c80. In this case, referring to FIG. 18, the input amplified voltage signals are sampled to form sampled voltage signals that are further digitized in the analog/digital converters to form digital signals connected to the input/output interface circuit c183 before inputting into the attitude and heading processor c80.

Referring to FIG. 5, the digital three-axis angular increment voltage values or real values and three-axis digital velocity increment voltage values or real values are produced and outputted from the angular increment and velocity increment producer c6.

In order to adapt to digital three-axis angular increment voltage values and three-axis digital velocity increment voltage values from the angular increment and velocity increment producer c6, the attitude and heading module c81, as shown in FIG. 19, comprises a coning correction module c811, wherein digital three-axis angular increment voltage values from the input/output interface circuit c65 of the angular increment and velocity increment producer c6 and coarse angular rate bias obtained from an angular rate producer and acceleration producer calibration constants table at a high data rate (short interval) are input into the coning correction module c811, which computes coning effect errors by using the input digital three-axis angular increment voltage values and coarse angular rate bias, and outputs three-axis coning effect terms and three-axis angular increment voltage values at a reduced data rate (long interval), which are called three-axis long-interval angular increment voltage values.

The attitude and heading module c81 further comprises an angular rate compensation module c812 and an alignment rotation vector computation module c815. In the angular rate compensation module c812, the coning effect errors and three-axis long-interval angular increment voltage values from the coning correction module c811 and angular rate device misalignment parameters, fine angular rate bias, angular rate device scale factor, and coning correction scale factor from the angular rate producer and acceleration producer calibration constants table are connected to the angular rate compensation module c812 for compensating definite errors in the three-axis long-interval angular increment voltage values using the coning effect errors, angular rate device misalignment parameters, fine angular rate bias, and coning correction scale factor, and transforming the compensated three-axis long-interval angular increment voltage values to real three-axis long-interval angular increments using the angular rate device scale factor. Moreover, the real three-axis angular increments are output to the alignment rotation vector computation module c815.

The attitude and heading module c81 further comprises an accelerometer compensation module c813 and a level acceleration computation module c814, wherein the three-axis velocity increment voltage values from the angular increment and velocity increment producer c6 and acceleration device misalignment, acceleration device bias, and acceleration device scale factor from the angular rate producer and acceleration producer calibration constants table are connected to the accelerometer compensation module c813 for transforming the three-axis velocity increment voltage values into real three-axis velocity increments using the acceleration device scale factor, and compensating the definite errors in three-axis velocity increments using the acceleration device misalignment, accelerometer bias, wherein the compensated three-axis velocity increments are connected to the level acceleration computation module c814.

By using the compensated three-axis angular increments from the angular rate compensation module c812, an east damping rate increment from an east damping rate computation module c8110, a north damping rate increment from a north damping rate computation module c819, and vertical damping rate increment from a vertical damping rate computation module c818, a quaternion, which is a vector representing rotation angle of the carrier, is updated, and the updated quaternion is connected to a direction cosine matrix computation module c816 for computing the direction cosine matrix, by using the updated quaternion.

The computed direction cosine matrix is connected to the level acceleration computation module c814 and an attitude and heading angle extract module c817 for extracting attitude and heading angle using the direction cosine matrix from the direction cosine matrix computation module c816.

The compensated three-axis velocity increments are connected to the level acceleration computation module c814 for computing level velocity increments using the compensated three-axis velocity increments from the acceleration compensation module c814 and the direction cosine matrix from the direction cosine matrix computation module c816.

The level velocity increments are connected to the east damping rate computation module c8110 for computing east damping rate increments using the north velocity increment of the input level velocity increments from the level acceleration computation module c814.

The level velocity increments are connected to the north damping rate computation module c819 for computing north damping rate increments using the east velocity increment of the level velocity increments from the level acceleration computation module c814.

The heading angle from the attitude and heading angle extract module c817 and a measured heading angle from the external heading sensor c90 are connected to the vertical damping rate computation module c818 for computing vertical damping rate increments.

The east damping rate increments, north damping rate increments, and vertical damping rate are fed back to the alignment rotation vector computation module c815 to damp the drift of errors of the attitude and heading angles.

Alternatively, in order to adapt real digital three-axis angular increment values and real three-axis digital velocity increment values from the angular increment and velocity increment producer c6, referring to FIG. 19, the real digital three-axis angular increment values from the angular increment and velocity increment producer c6 and coarse angular rate bias obtained from an angular rate producer and acceleration producer calibration constants table at a high data rate (short interval) are connected to the coning correction module c811 for computing coning effect errors in the coning correction module c811 using the digital three-axis angular increment values and coarse angular rate bias and outputting three-axis coning effect terms and three-axis angular increment values at reduced data rate (long interval), which are called three-axis long-interval angular increment values, into the angular rate compensation module c812.

The coning effect errors and three-axis long-interval angular increment values from the coning correction module c811 and angular rate device misalignment parameters and fine angular rate bias from the angular rate producer and acceleration producer calibration constants table are connected to the angular rate compensation module c812 for compensating definite errors in the three-axis long-interval angular increment values using the coning effect errors, angular rate device misalignment parameters, fine angular rate bias, and coning correction scale factor, and outputting the real three-axis angular increments to the alignment rotation vector computation module c815.

The three-axis velocity increment values from the angular increment and velocity increment producer c6 and acceleration device misalignment, and acceleration device bias from the angular rate producer and acceleration producer calibration are connected into the accelerometer compensation module c813 for compensating the definite errors in three-axis velocity increments using the acceleration device misalignment, and accelerometer bias; outputting the compensated three-axis velocity increments to the level acceleration computation module c814.

It is identical to the above mentioned processing that the following modules use the compensated three-axis angular increments from the angular rate compensation module c812 and compensated three-axis velocity increments from the acceleration compensation module c813 to produce attitude and heading angle.

Figure 18:
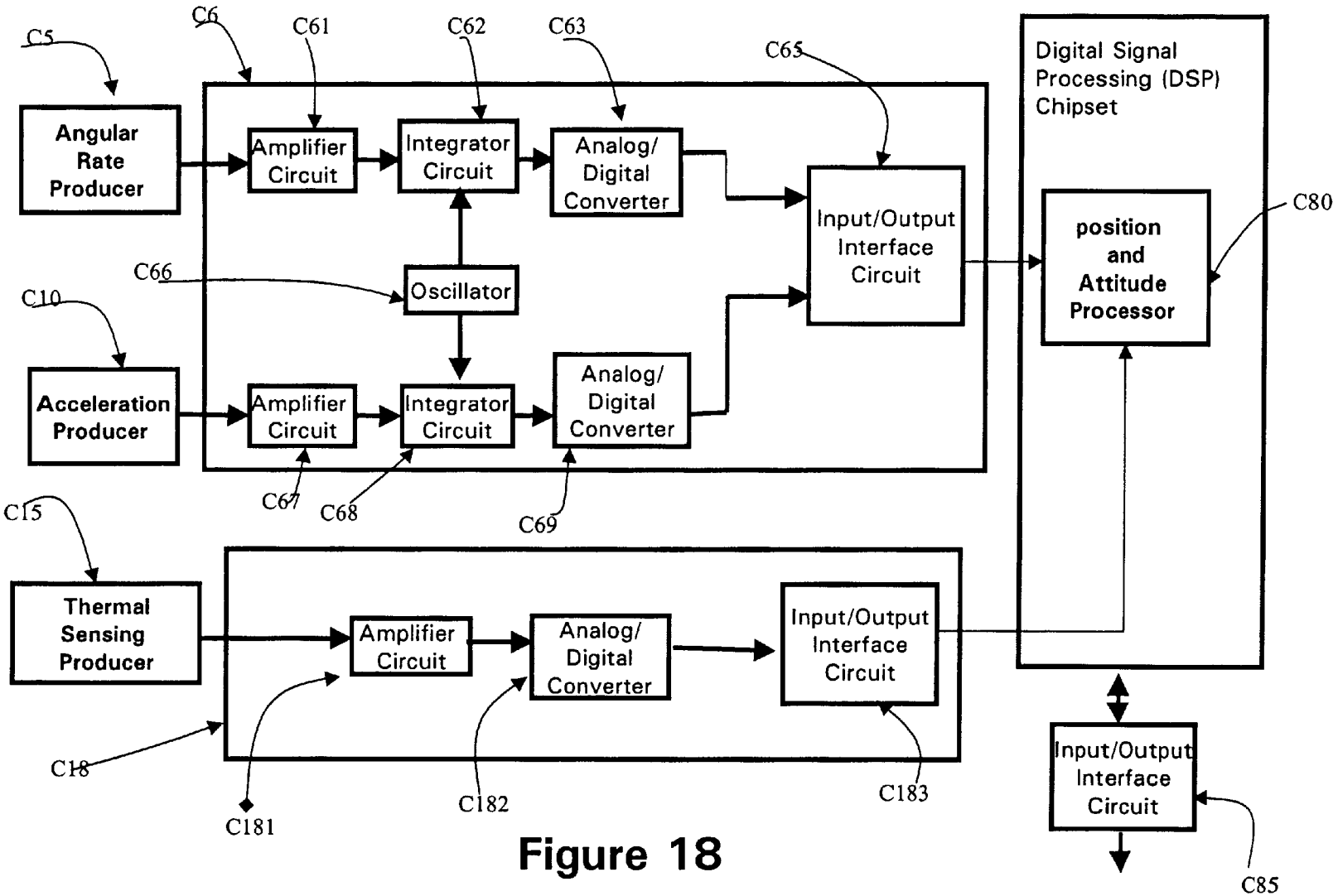
FIG. 18 is a block diagram illustrating a processing module with thermal compensation processing for the micro inertial measurement unit according to the above preferred embodiment of the present invention.

Referring to FIGS. 7, 18, and, 19, which use the temperature compensation method by means of the temperature digitizer c18, in order to adapt to digital three-axis angular increment voltage value and three-axis digital velocity increment voltage values from the angular increment and velocity increment producer c6, the digital three-axis angular increment voltage values from the angular increment and velocity increment producer c6 and coarse angular rate bias obtained from an angular rate producer and acceleration producer calibration constants table at a high data rate (short interval) are connected to the coning correction module c811 for computing coning effect errors in the coning correction module c811 using the digital three-axis angular increment voltage values and coarse angular rate bias, and outputting three-axis coning effect terms and three-axis angular increment voltage values at a reduced data rate (long interval), which are called three-axis long-interval angular increment voltage values, into the angular rate compensation module c812.

The coning effect errors and three-axis long-interval angular increment voltage values from the coning correction module c811 and angular rate device misalignment parameters, fine angular rate bias, angular rate device scale factor, coning correction scale factor from the angular rate producer and acceleration producer calibration constants table, the digital temperature signals from input/output interface circuit c183, and temperature sensor scale factor are connected to the angular rate compensation module c812 for computing current temperature of the angular rate producer, accessing angular rate producer temperature characteristic parameters using the current temperature of the angular rate producer, compensating definite errors in the three-axis long-interval angular increment voltage values using the coning effect errors, angular rate device misalignment parameters, fine angular rate bias, and coning correction scale factor, transforming the compensated three-axis long-interval angular increment voltage values to real three-axis long-interval angular increments, compensating temperature-induced errors in the real three-axis long-interval angular increments using the angular rate producer temperature characteristic parameters, and outputting the real three-axis angular increments to the alignment rotation vector computation module c815.

The three-axis velocity increment voltage values from the angular increment and velocity increment producer c6 and acceleration device misalignment, acceleration bias, acceleration device scale factor from the angular rate producer and acceleration producer calibration constants table, the digital temperature signals from the input/output interface circuit c183 of the temperature digitizer c18, and temperature sensor scale factor are connected to the acceleration compensation module c813 for computing current temperature of the acceleration producer, accessing acceleration producer temperature characteristic parameters using the current temperature of the acceleration producer, transforming the three-axis velocity increment voltage values into real three-axis velocity increments using the acceleration device scale factor, compensating the definite errors in the three-axis velocity increments using the acceleration device misalignment and acceleration bias, compensating temperature-induced errors in the real three-axis velocity increments using the acceleration producer temperature characteristic parameters, and outputting the compensated three-axis velocity increments to the level acceleration computation module c814.

It is identical to the above mentioned processing that the following modules use the compensated three-axis angular increments from the angular rate compensation module c812 and compensated three-axis velocity increments from the acceleration compensation module c813 to produce the attitude and heading angles.

Alternatively, referring, to FIGS. 5, 7, 18, and 19, which use the temperature compensation method, in order to adapt real digital three-axis angular increment values and real three-axis digital velocity increment values from the angular increment and velocity increment producer c6, the attitude and heading module c811 can be further modified to accept the digital three-axis angular increment values from the angular increment and velocity increment producer c6 and coarse angular rate bias obtained from an angular rate producer and acceleration producer calibration constants table at a high data rate (short interval) into the coning correction module c811 for computing coning effect errors in the coning correction module c811 using the input digital three-axis angular increment values and coarse angular rate bias, and outputting three-axis coning effect data and three-axis angular increment data at a reduced data rate (long interval), which are called three-axis long-interval angular increment values, into the angular rate compensation module c812.

The coning effect errors and three-axis long-interval angular increment values from the coning correction module c811 and angular rate device misalignment parameters and fine angular rate bias from the angular rate producer and acceleration producer calibration constants table, the digital temperature signals from the input/output interface circuit c183 and temperature sensor scale factor are connected to the angular rate compensation module c812 for computing current temperature of the angular rate producer, accessing angular rate producer temperature characteristic parameters using the current temperature of the angular rate producer, compensating definite errors in the three-axis long-interval angular increment values using the coning effect errors, angular rate device misalignment parameters, fine angular rate bias, and coning correction scale factor, compensating temperature-induced errors in the real three-axis long-interval angular increments using the angular rate producer temperature characteristic parameters, and outputting the real three-axis angular increments to an alignment rotation vector computation module c815.

The three-axis velocity increment values from the input/output interface circuit c65 and acceleration device misalignment and acceleration bias from the angular rate producer and acceleration producer calibration constants table, the digital temperature signals from the input/output interface circuit c183 and temperature sensor scale factor are input into the acceleration compensation module c813 for computing current temperature of the acceleration producer, accessing the acceleration producer temperature characteristic parameters using the current temperature of the acceleration producer, compensating the definite errors in the three-axis velocity increments using the input acceleration device misalignment, acceleration bias, compensating temperature-induced errors in the real three-axis velocity increments using the acceleration producer temperature characteristic parameters, and outputting the compensated three-axis velocity increments to the level acceleration computation module c814.

It is identical to the above mentioned processing that the following modules use the compensated three-axis angular increments from the angular rate compensation module c812 and compensated three-axis velocity increments from the acceleration compensation module c813 to produce the attitude and heading angles.

Figure 20:
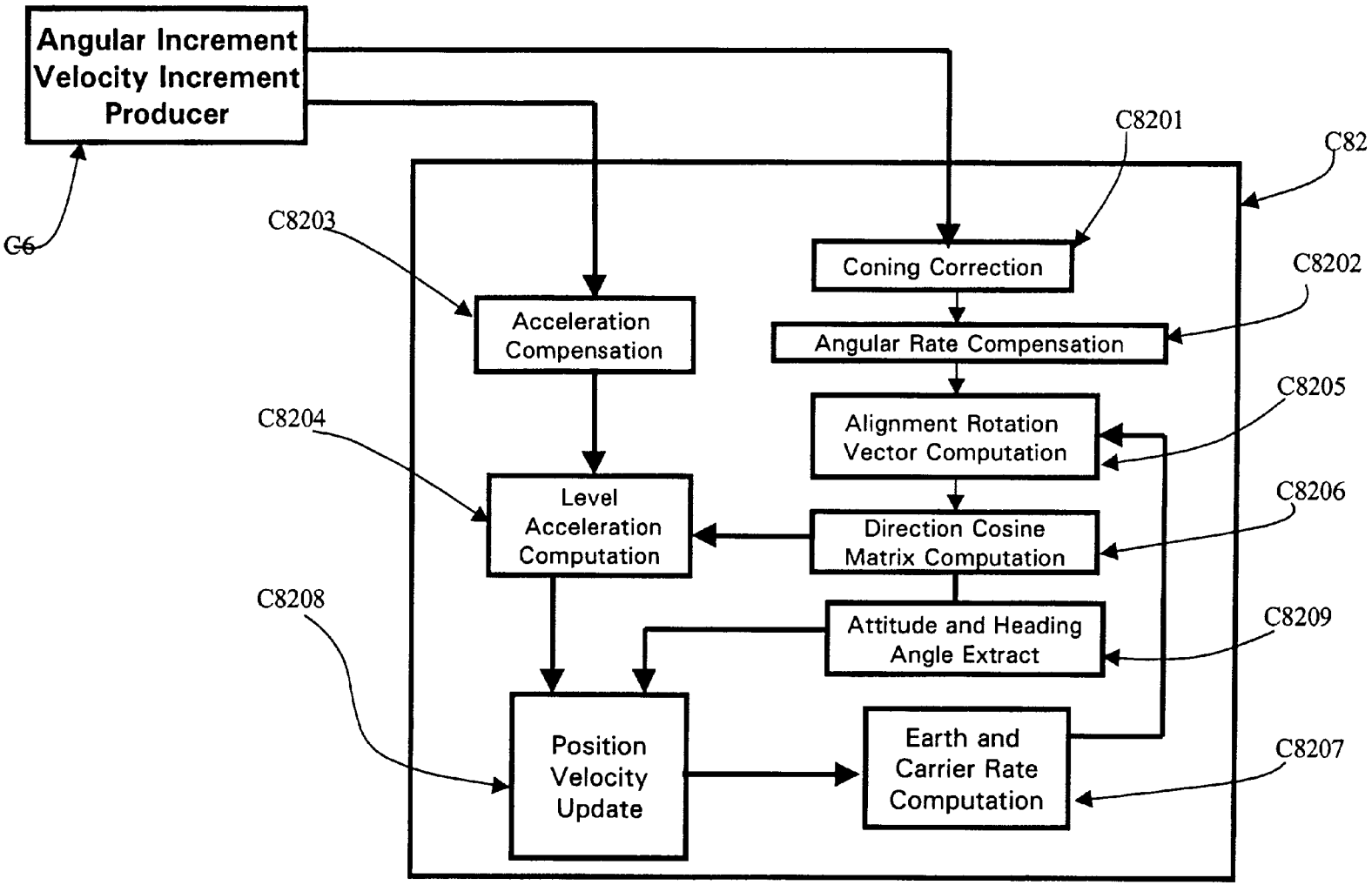
FIG. 20 is a functional block diagram illustrating the position velocity attitude and heading module according to the above preferred embodiment of the present invention.

Referring to FIG. 20, the Position, velocity, and attitude Module c82 comprises:

- a coning correction module c8201, which is same as the coning correction module c811 of the attitude and heading module c81;
- an angular rate compensation module c8202, which is same as the angular rate compensation module c812 of the attitude and heading module c81;
- an alignment rotation vector computation module c8205, which is same as the alignment rotation vector computation module c815 of the attitude and heading module c81;
- a direction cosine matrix computation module c8206, which is same as the Direction cosine matrix computation module c816 of the attitude and heading module c81;
- an acceleration compensation module c8203, which is same as the acceleration compensation module c813 of the attitude and heading module c81;
- a level acceleration computation module c8204, which is same as the acceleration compensation module c814 of the attitude and heading module c81; and
- an attitude and heading angle extract module c8209, which is same as the attitude and heading angle extract module c817 of the attitude and heading module c81.

A position and velocity update module c8208 accepts the level velocity increments from the level acceleration computation module c8204 and computes position and velocity solution.

An earth and carrier rate computation module c8207 accepts the position and velocity solution from the position and velocity update module c8208 and computes the rotation rate vector of the local navigation frame (n frame) of the carrier relative to the inertial frame (i frame), which is connected to the alignment rotation vector computation module c8205.

In order to meet the diverse requirements of application systems, referring to FIGS. 15 and 31 the digital three-axis angular increment voltage values, the digital three-axis velocity increment, and digital temperature signals in the input/output interface circuit c65 and the input/output interface circuit c305 can be ordered with a specific format required by an external user system, such as RS-232 serial communication standard, RS-422 serial communication standard, the popular PCI/ISA bus standard, and 1553 bus standard, etc.

Figure 28:
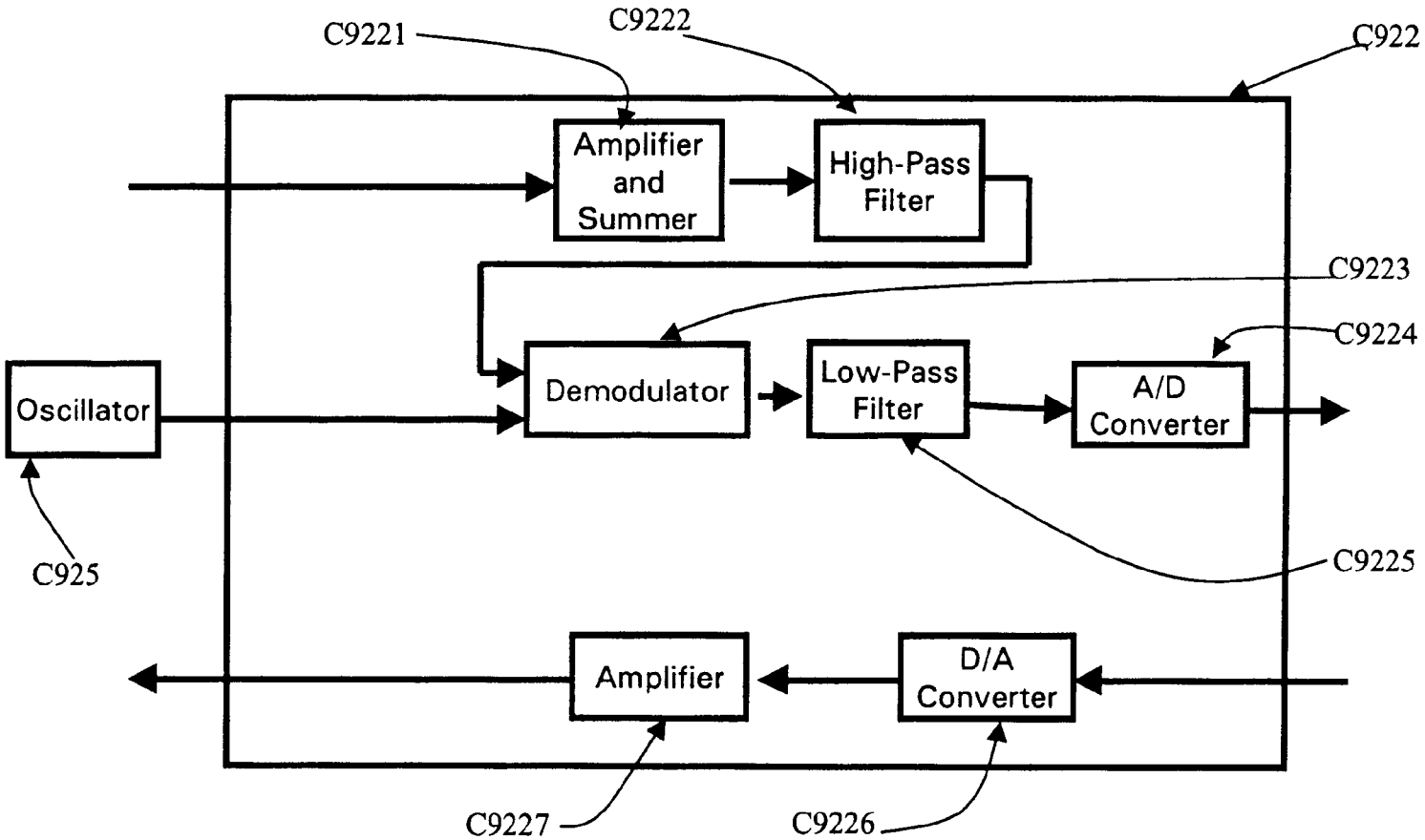
FIG. 28 is block diagram of the dither motion control circuitry of the ASIC chip in the third circuit board of the micro IMU according to the above preferred embodiment of the present invention.

In order to meet diverse requirements of application systems, referring to. FIGS. 28 and 31, the digital three-axis angular increment values, the digital three-axis velocity increment, and attitude and heading data in the input/output interface circuit c85 are ordered with a specific format required by an external user system, such as RS-232 serial communication standard, RS-422 serial communication standard, PCI/ISA bus standard, and 1553 bus standard, etc.

As mentioned above, one of the key technologies of the present invention to achieve the micro IMU with a high degree of performance is to utilize a micro size angular rate producer, wherein the micro-size angular rate producer with MEMS technologies and associated mechanical supporting structure and circuitry board deployment of the micro IMU of the present invention are disclosed in the following description.

Another of the key technologies of the present invention to achieve the micro IMU with low power consumption is to design, a micro size circuitry with small power consumption, wherein the conventional AISC (Application Specific Integrated Circuit) technologies can be utilized to shrink a complex circuitry into a silicon chip.

Existing MEMS technologies, which are employed into the micro size angular rate producer, use vibrating inertial elements (a micromachine) to sense vehicle angular rate via the Coriolis Effect. The angular rate sensing principle of Coriolis Effect is the inspiration behind the practical vibrating angular rate sensors.

The Coriolis Effect can be explained by saying that when an angular rate is applied to a translating or vibrating inertial element, a Coriolis force is generated. When this angular rate is applied to the axis of an oscillating inertial element, its tines receive a Coriolis force, which then produces torsional forces about the sensor axis. These forces are proportional to the applied angular rate, which then can be measured.

The force (or acceleration), Coriolis force (or Coriolis acceleration) or Coriolis effect, is originally named from a French physicist and mathematician, Gaspard de Coriolis (1792–1843), who postulated his acceleration in 1835 as a correction for the earth's rotation in ballistic trajectory calculations. The Coriolis acceleration acts on a body that is moving around a point with a fixed angular velocity and moving radially as well.

The basic equation defining Coriolis force is expressed as follows:

$$\vec{F}_{Coriolis}=m\vec{a}_{Coriolis}=2m(\vec{\omega}\times\vec{V}_{Oscillation})$$

where $\vec{F}_{Coriolis}$ is the detected Coriolis force;

m is the mass of the inertial element;

$\vec{a}_{Coriolis}$ is the generated Coriolis acceleration;

$\vec{\omega}$ is the applied (input) angular rotation rate;

$\vec{V}_{Oscillation}$ is the oscillation velocity in a rotating frame.

The Coriolis force produced is proportional to the product of the mass of the inertial element, the input rotation rate, and the oscillation velocity of the inertial element that is perpendicular to the input rotation rate.

The major problems with micromachined vibrating type angular rate producer are insufficient accuracy, sensitivity, and stability. Unlike MEMS acceleration producers that are passive devices, micromachined vibrating type angular rate producer are active devices. Therefore, associated high performance electronics and control should be invented to effectively use hands-on micromachined vibrating type angular rate producers to achieve high performance angular rate measurements in order to meet the requirement of the micro IMU.

Therefore, in order to obtain angular rate sensing signals from a vibrating type angular rate detecting unit, a dither drive signal or energy must be fed first into the vibrating type angular rate detecting unit to drive and maintain the oscillation of the inertial elements with a constant momentum. The performance of the dither drive signals is critical for the whole performance of a MEMS angular rate producer.

Figure 21:
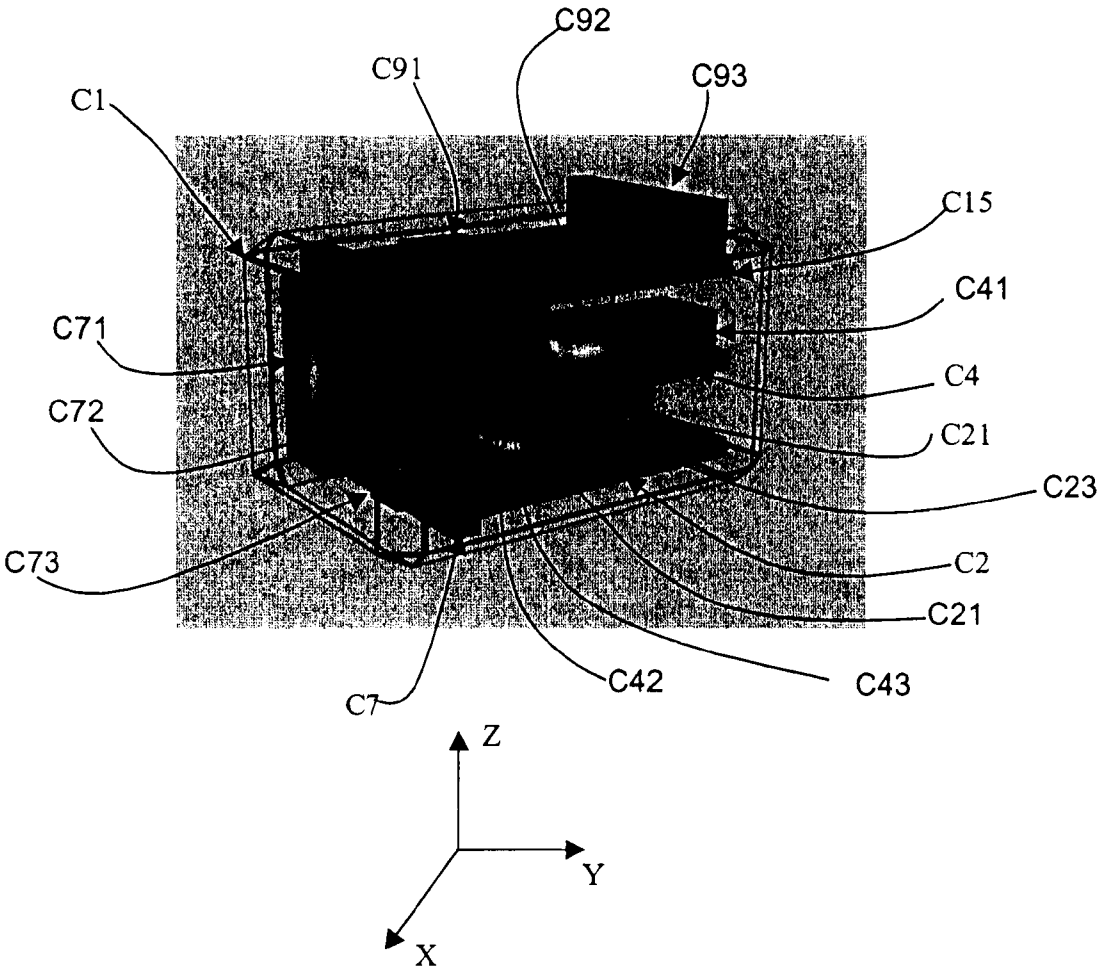
FIG. 21 is a perspective view illustrating the inside mechanical structure and circuit board deployment in the micro IMU according to the above preferred embodiment of the present invention.
Figure 22:
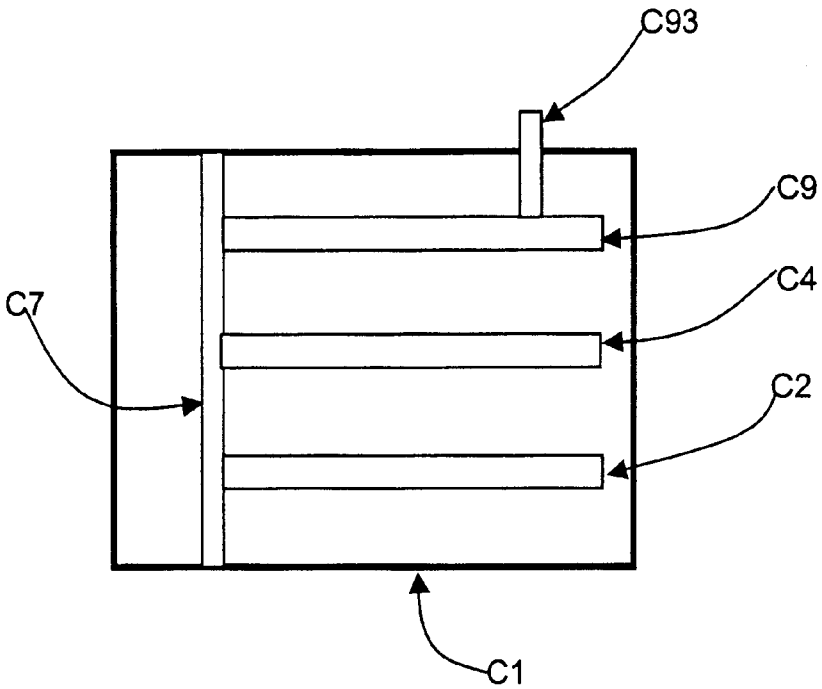
FIG. 22 is a sectional side view of the micro IMU according to the above preferred embodiment of the present invention.

As shown in FIG. 21 and FIG. 22, which are a perspective view and a sectional view of the micro IMU of the present invention as shown in the block diagram of FIG. 18, the micro IMU comprises a first circuit board c2, a second circuit board c4, a third circuit board c7, and a control circuit board c9 arranged inside a metal cubic case c1.

The first circuit board c2 is connected with the third circuit board c7 for producing X axis angular sensing signal and Y axis acceleration sensing signal to the control circuit board c9.

The second circuit board c4 is connected with the third circuit board c7 for producing Y axis angular sensing signal and X axis acceleration sensing signal to the control circuit board c9.

The third circuit board c7 is connected with the control circuit board c9 for producing Z axis angular sensing signal and Z axis acceleration sensing signals to the control circuit board c9.

The control circuit board c9 is connected with the first circuit board c2 and then the second circuit board c4 through the third circuit board c7 for processing the X axis, Y axis and Z axis angular sensing signals and the X axis Y axis and Z axis acceleration sensing signals from the first, second and control circuit board to produce digital angular increments and velocity increments, position, velocity, and attitude solution.

Figure 23:
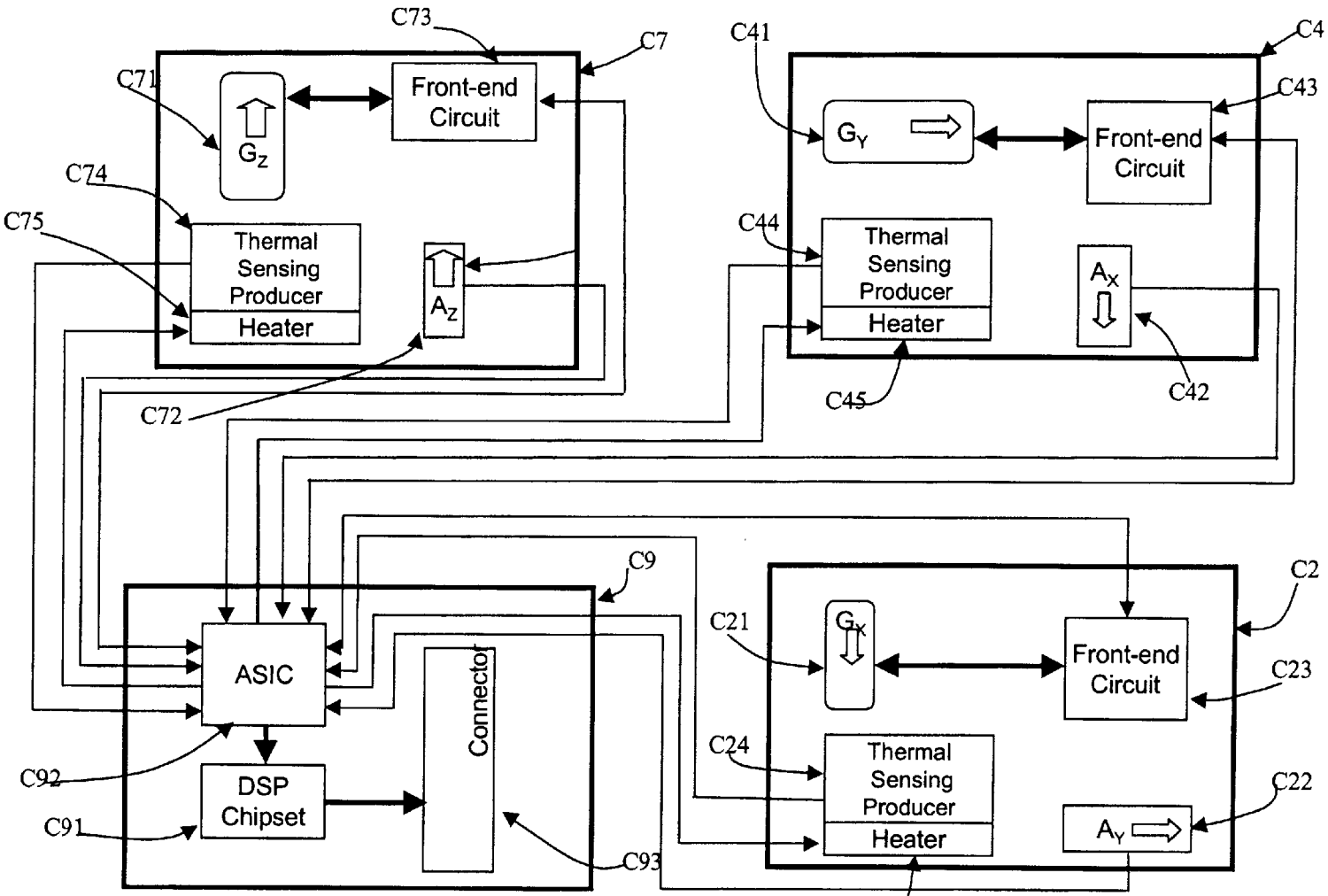
FIG. 23 is a block diagram illustrating the connection among the four circuit boards inside the micro IMU according to the above preferred embodiment of the present invention.
Figure 24:
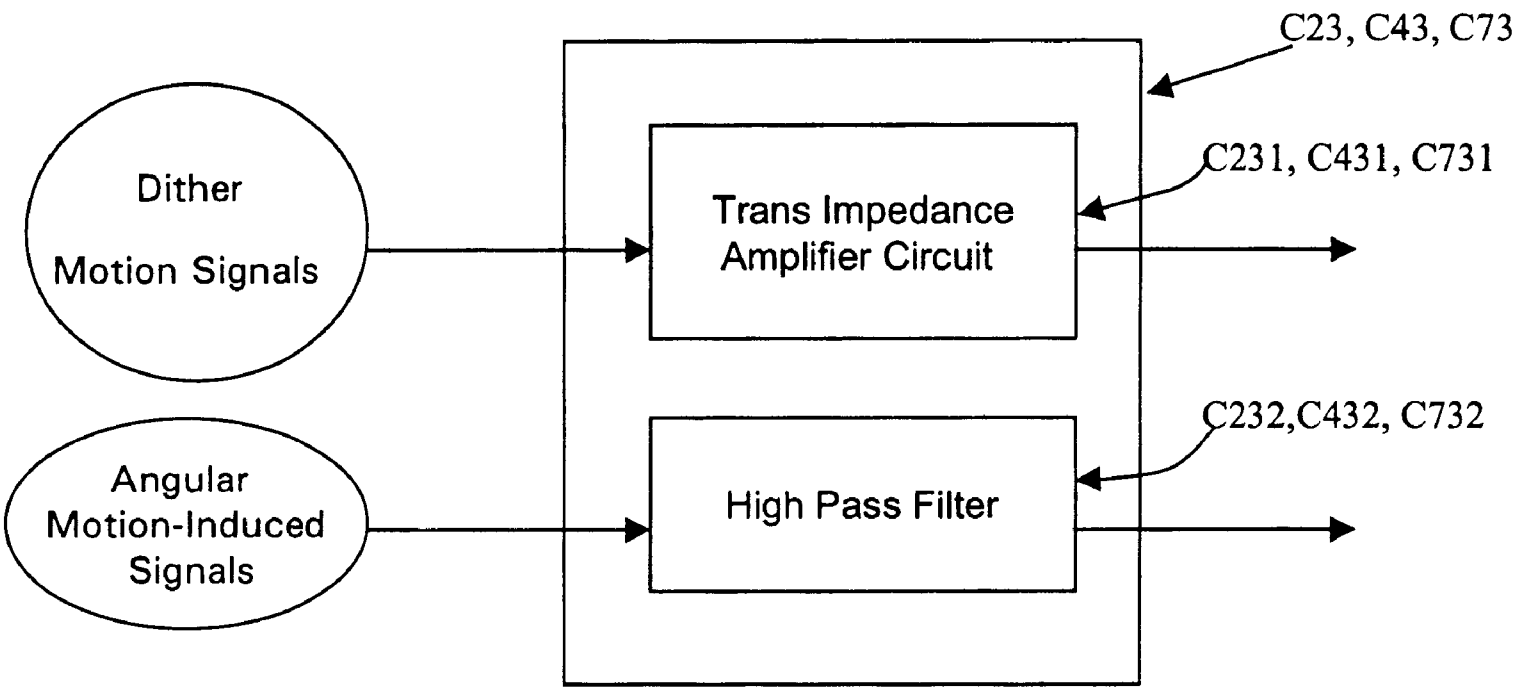
FIG. 24 is a block diagram of the front-end circuit in each of the first, second, and fourth circuit boards of the micro IMU according to the above preferred embodiment of the present invention.
Figure 25:
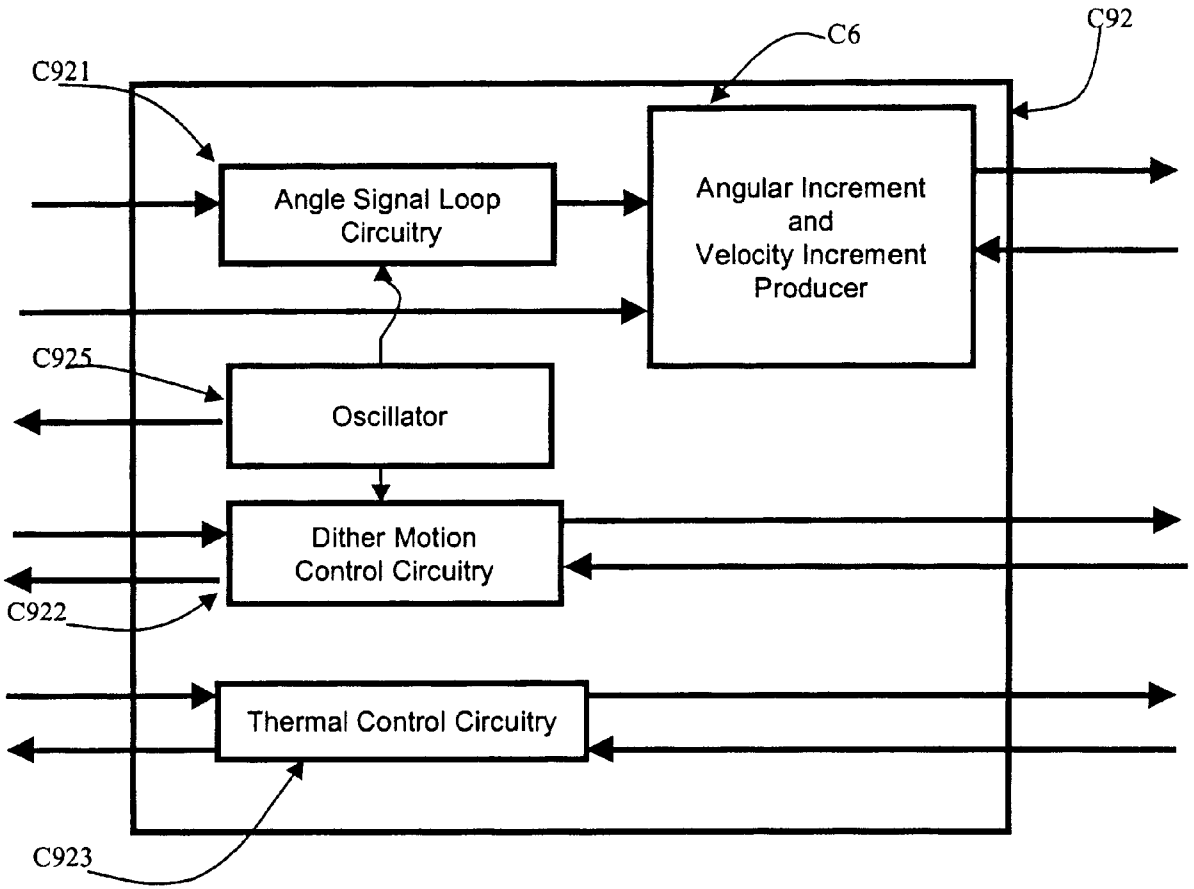
FIG. 25 is a block diagram of the ASIC chip in the third circuit board of the micro IMU according to the above preferred embodiment of the present invention.
Figure 26:
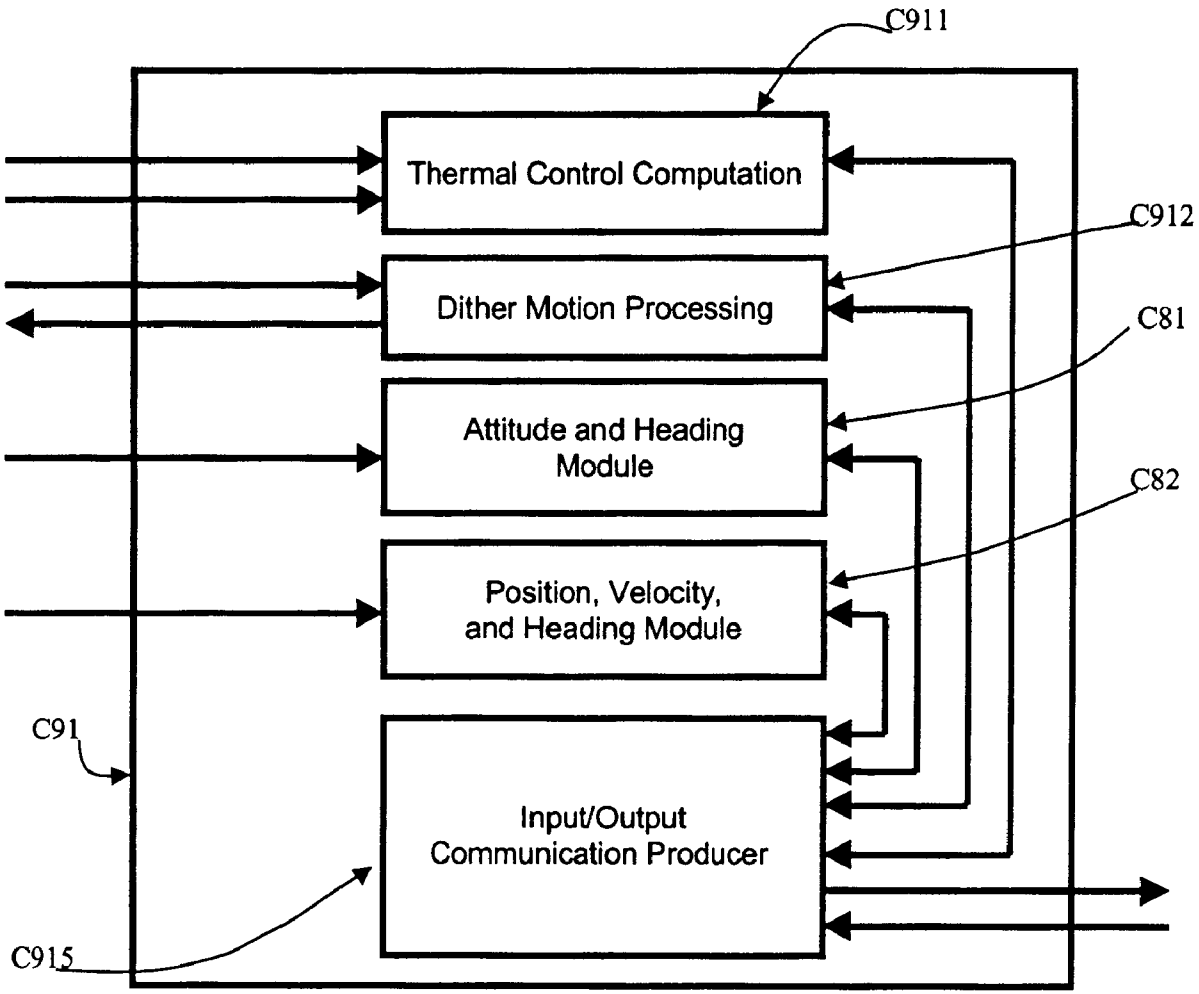
FIG. 26 is a block diagram of processing modules running in the DSP chipset in the third circuit board of the micro IMU according to the above preferred embodiment of the present invention.

As shown in FIG. 23, the angular producer c5 of the preferred embodiment of the present invention comprises:

an X axis vibrating type angular rate detecting unit c21 and a first front-end circuit c23 connected on the first circuit board c2;

a Y axis vibrating type angular rate detecting unit c41 and a second front-end circuit c43 connected on the second circuit board c4;

a Z axis vibrating type angular rate detecting unit c71 and a third front-end circuit c73 connected on the third circuit board c7;

three angular signal loop circuitries c921, which are provided in a ASIC chip c92 connected on the control circuit board c9, for the first, second and third circuit boards c2, c4, c7 respectively;

three dither motion control circuitries c922, which are provided in the ASIC chip c92 connected on the control circuit board c9, for the first, second and third circuit boards c2, c4, c7 respectively;.

an oscillator c925 adapted for providing reference pickoff signals for the X axis vibrating type angular rate detecting unit c21, the Y axis vibrating type angular rate detecting unit c41, the Z axis vibrating type angular rate detecting unit c71, the angle signal loop circuitry c921, and the dither motion control circuitry c922; and three dither motion processing modules c912, which run in a DSP (Digital Signal Processor) chipset c91 connected on the control circuit board c9, for the first, second and third circuit boards c2, c4, c7 respectively.

The first, second and third front-end circuits c23, c43, c73, each of which is structurally identical, are used to condition the output signal of the X axis, Y axis and Z axis vibrating type angular rate detecting units c21, c41, c71 respectively and each further comprises:

a trans impedance amplifier circuit c231, c431, c731, which is connected to the respective X axis, Y axis or Z axis vibrating type angular rate detecting unit c21, c41, c71 for changing the output impedance of the dither motion signals from a very high level, greater than 100 million ohms, to a low level, less than 100 ohms to achieve two dither displacement signals, which are A/C voltage signals representing the displacement between the inertial elements and the anchor combs. The two dither displacement signals are output to the dither motion control circuitry c922; and a high-pass filter circuit c232, c432, c732, which is connected with the respective X axis, Y axis or Z axis vibrating type angular rate detecting units c21, c41, c71 for removing residual dither drive signals and noise from the dither displacement differential signal to form a filtered dither displacement differential signal to the angular signal loop circuitry c921.

Each of the X axis, Y axis and Z axis angular rate detecting units c21, c41, and c71 is structurally identical except that sensing axis of each angular rate detecting unit is placed in an orthogonal direction. The X axis angular rate detecting unit c21 is adapted to detect the angular rate of the vehicle along X axis. The Y axis angular rate detecting unit c21 is adapted to detect the angular rate of the vehicle along Y axis. The Z axis angular rate detecting unit c21 is adapted to detect the angular rate of the vehicle along Z axis.

Each of the X axis, Y axis and Z axis angular rate detecting units c21, c41 and c71 is a vibratory device, which comprises at least one set of vibrating inertial elements, including tuning forks, and associated supporting structures and means, including capacitive readout means, and uses Coriolis effects to detect vehicle angular rate.

Each of the X axis, Y axis and Z axis vibrating type angular rate detecting units c21, c41, c71 receives signals as follows:

1) dither drive signals from the respective dither motion control circuitry c922, keeping the inertial elements oscillating; and 2) carrier reference oscillation signals from the oscillator c925, including capacitive pickoff excitation signals.

Each of the X axis, Y axis and Z axis vibrating type angular rate detecting units c21, c41, c71 detects the angular motion in X axis, Y axis and Z axis respectively of a vehicle in accordance with the dynamic theory (Coriolis force), and outputs signals as follows:

1) angular motion-induced signals, including rate displacement signals which may be modulated carrier reference oscillation signals to a trans Impedance amplifier circuit c231, c431, c731 of the first, second, and third front-end circuit c23; and
2) its inertial element dither motion signals, including dither displacement signals, to the high-pass filter c232, c432, c732 of the first, second, and third front-end circuit c23.

The three dither motion control circuitries c922 receive the inertial element dither motion signals from the X axis, Y axis and Z axis vibrating type angular rate detecting units c21, c41, c71 respectively, reference pickoff signals from the oscillator c925, and produce digital inertial element displacement signals with known phase.

In order to convert the inertial element dither motion signals from the X axis, Y axis and Z axis vibrating type angular rate detecting units c21, c41, c71 to processible inertial element dither motion signals, referring to FIG. 28, each of the dither motion control circuitries c922 comprises:

an amplifier and summer circuit c9221 connected to the trans impedance amplifier circuit c231, c431, c731 of the respective first, second or third front-end circuit c23, c43, c73 for amplifying the two dither displacement signals for more than ten times and enhancing the sensitivity for combining the two dither displacement signals to achieve a dither displacement differential signal by subtracting a center anchor comb signal with a side anchor comb signal;

a high-pass filter circuit c9222 connected to the amplifier and summer circuit c9221 for removing residual dither drive signals and noise from the dither displacement differential signal to form a filtered dither displacement differential signal;

a demodulator circuit c9223 connected to the high-pass filter circuit c2225 for receiving the capacitive pickoff excitation signals as phase reference signals from the, oscillator c925 and the filtered dither displacement differential signal from the high-pass filter c9222 and extracting the in-phase portion of the filtered dither displacement differential signal to produce an inertial element displacement signal with known phase;

a low-pass filter c9225 connected to the demodulator circuit c9223 for removing high frequency noise from the inertial element displacement signal input thereto to form a low frequency inertial element displacement signal;

an analog/digital converter c9224 connected to the low-pass filter c9225 for converting the low frequency inertial element displacement analog signal to produce a digitized low frequency inertial element displacement signal to the dither motion processing module c912 (disclosed in the following text) running the DSP chipset c91;

a digital/analog converter c9226 processing the selected amplitude from the dither motion processing module c912 to form a dither drive signal with the correct amplitude; and an amplifier c9227 which generates and amplifies the dither drive signal to the respective X axis, Y axis or Z axis vibrating type angular rate detecting unit c21, c41, c71 based on the dither drive signal with the selected frequency and correct amplitude.

The oscillation of the inertial elements residing inside each of the X axis, Y axis and Z axis vibrating type angular rate detecting units c21, c41, c71 is generally driven by a high frequency sinusoidal signal with precise amplitude. It is critical to provide the X axis, Y axis and Z axis vibrating type angular rate detecting units c21, c41, c71 with high performance dither drive signals to achieve keen sensitivity and stability of X-axis, Y-axis and Z axis angular rate measurements.

The dither motion processing module c912 receives digital inertial element displacement signals with known phase from the analog/digital converter c9224 of the dither motion control circuitry c922 for:

(1) finding the frequencies which have the highest Quality Factor (Q) Values,
(2) locking the frequency, and
(3) locking the amplitude to produce a dither drive signal, including high frequency sinusoidal signals with a precise amplitude, to the respective X axis, Y axis or Z axis vibrating type angular rate detecting unit c21, c41, c71 to keep the inertial elements oscillating at the pre-determined resonant frequency.

The three dither motion processing modules c912 is to search and lock the vibrating frequency and amplitude of the inertial elements of the respective X axis, Y axis or Z axis vibrating type angular rate detecting unit c21, c41, c71. Therefore, the digitized low frequency inertial element displacement signal is first represented in terms of its spectral content by using discrete Fast Fourier Transform (FFT).

Discrete Fast Fourier Transform (FFT) is an efficient algorithm for computing discrete Fourier transform (DFT), which dramatically reduces the computation load imposed by the DFT. The DFT is used to approximate the Fourier transform of a discrete signal. The Fourier transform, or spectrum, of a continuous signal is defined as:

$$X(j\omega) = \int_{-\infty}^{\infty} x(t)e^{-j\omega t}dt$$

The DFT of N samples of a discrete signals X(nT) is given by:

$$X_s(k\omega) = \sum_{n=0}^{N-1} x(nT)e^{-j\omega Tnk}$$

where $\omega=2\pi/NT$, T is the inter-sample time interval. The basic property of FFT is its ability to distinguish waves of different frequencies that have been additively combined.

After the digitized low frequency inertial element displacement signals are represented in terms of their spectral content by using discrete Fast Fourier Transform (FFT), Q (Quality Factor) Analysis is applied to their spectral content to determine the frequency with global maximal Q value. The vibration of the inertial elements of the respective X axis, Y axis or Z axis vibrating type angular rate detecting unit c21, c41, c71 at the frequency with global maximal Q value can result in minimal power consumption and cancel many of the terms that affect the excited mode. The Q value is a function of basic geometry, material properties, and ambient operating conditions.

A phase-locked loop and digital/analog converter is further used to control and stabilize the selected frequency and amplitude.

Figure 30:
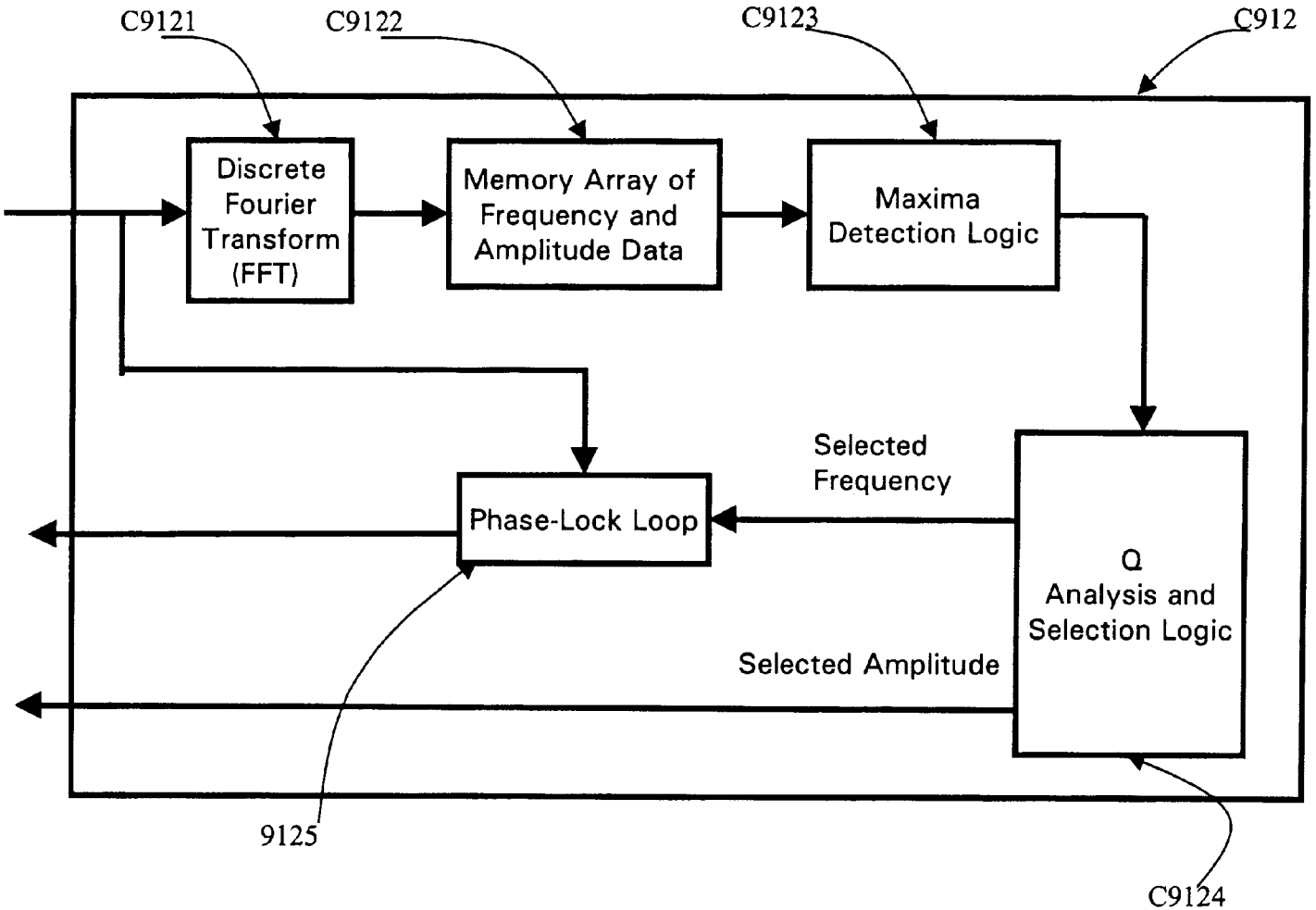
FIG. 30 is a block diagram of the dither motion processing module running in the DSP chipset of the third circuit board of the micro IMU according to the above preferred embodiment of the present invention.

Referring to FIG. 30, the dither motion processing module c912 further includes a discrete Fast Fourier Transform (FFT) module c9121, a memory array of frequency and amplitude data module c9122, a maxima detection logic module c9123, and a Q analysis and selection logic module c9124 to find the frequencies which have the highest Quality Factor (Q) Values.

The discrete Fast Fourier Transform (FFT) module c9121 is arranged for transforming the digitized low frequency inertial element displacement signal from the analog/digital converter c9224 of the dither motion control circuitry c922 to form amplitude data with the frequency spectrum of the input inertial element displacement signal.

The memory array of frequency and amplitude data module c9122 receives the amplitude data with frequency spectrum to form an array of amplitude data with frequency spectrum.

The maxima detection logic module c9123 is adapted for partitioning the frequency spectrum from the array of the amplitude data with frequency into plural spectrum segments, and choosing those frequencies with the largest amplitudes in the local segments of the frequency spectrum.

The Q analysis and selection logic module c9124 is adapted for performing Q analysis on the chosen frequencies to select frequency and amplitude by computing the ratio of amplitude/bandwidth, wherein the range for computing bandwidth is between +−½ of the peek for each maximum frequency point.

Moreover, the dither motion processing module c912 further includes a phase-lock loop c9125 to reject noise of the selected frequency to form a dither drive signal with the selected frequency, which serves as a very narrow bandpass filter, locking the frequency.

Figure 27:
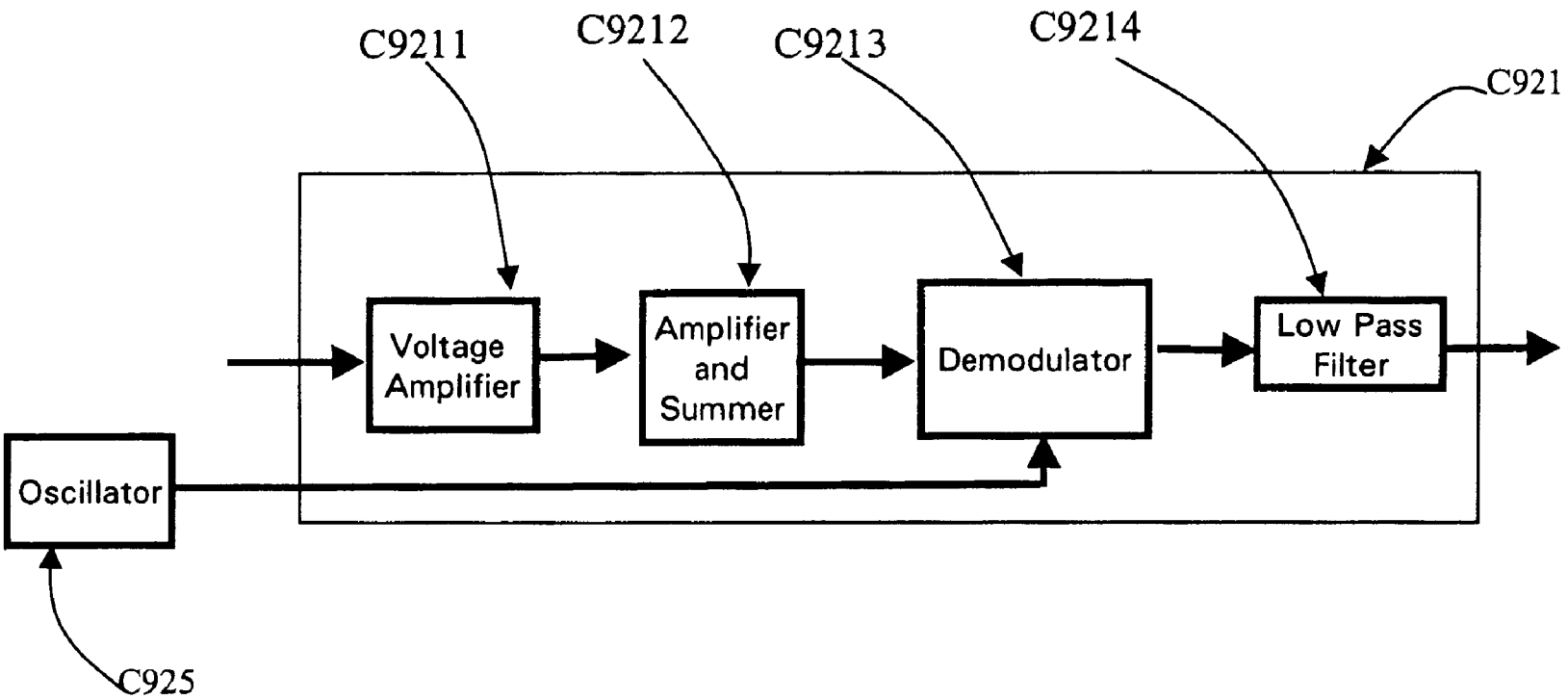
FIG. 27 is a block diagram of the angle signal loop circuitry of the ASIC chip in the third circuit board of the micro IMU according to the above preferred embodiment of the present invention.

The three angle signal loop circuitries c921 receive the angular motion-induced signals from the X axis, Y axis and Z axis vibrating type angular rate detecting units c21, c41, c71 respectively, reference pickoff signals from the oscillator c925, and transform the angular motion-induced signals into angular rate signals. Referring to FIG. 27, each of the angle signal loop circuitries c921 for the respective first, second or third circuit board c2, c4, c7 comprises:

- a voltage amplifier circuit c9211, which amplifies the filtered angular motion-induced signals from the high-pass filter circuit c232 of the respective first, second or third front-end circuit c23, c43, c73 to an extent of at least 100 milivolts to form amplified angular motion-induced signals;
- an amplifier and summer circuit c9212, which subtracts the difference between the angle rates of the amplified angular motion-induced signals to produce a differential angle rate signal;
- a demodulator c9213, which is connected to the amplifier and summer circuit c9212, extracting the amplitude of the in-phase differential angle rate signal from the differential angle rate signal and the capacitive pickoff excitation signals from the oscillator c925;
- a low-pass filter c9214, which is connected to the demodulator c9213, removing the high frequency noise of the amplitude signal of the in-phase differential angle rate signal to form the angular rate signal output to the angular increment and velocity increment producer c6.

Figure 14:
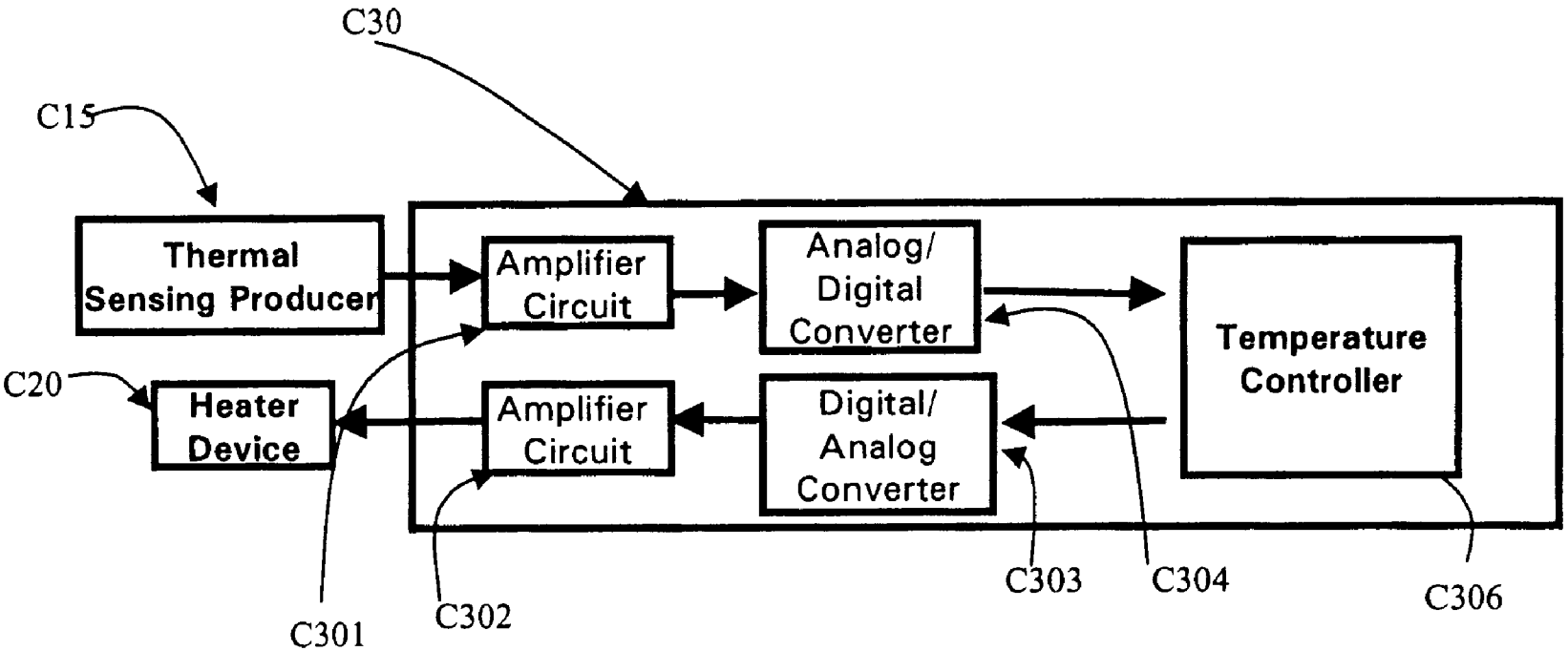
FIG. 14 is a block diagram illustrating another thermal processor for outputting analog voltage signals of the thermal sensing producer according to the above preferred embodiment of the present invention.

Referring to FIGS. 14 to 16, the acceleration producer c10 of the preferred embodiment of the present invention comprises:

- a X axis accelerometer c42, which is provided on the second circuit board c4 and connected with the angular increment and velocity increment producer 6 provided in the AISC chip c92 of the control circuit board c9;
- a Y axis accelerometer c22, which is provided on the first circuit board c2 and connected with angular increment and velocity increment producer c6 provided in the AISC chip c92 of the control circuit board c9; and
- a Z axis accelerometer c72, which is provided on the third circuit board 7 and connected with angular increment and velocity increment producer 6 provided in the AISC chip c92 of the control circuit board c9.

Referring to FIGS. 6, 22 and FIG. 23, thermal sensing producer device c15 of the preferred embodiment of the present invention further comprises:

- a first thermal sensing producing unit c24 for sensing the temperature of the X axis angular rate detecting unit c21 and the Y axis accelerometer c22;
- a second thermal sensing producer c44 for sensing the temperature of the Y axis angular rate detecting unit c41 and the X axis accelerometer c42; and
- a third thermal sensing producer c74 for sensing the temperature of the Z axis angular rate detecting unit c71 and the Z axis accelerometer c72.

Referring to FIGS. 6 and 23, the heater device c20 of the preferred embodiment of the present invention further comprises:

- a first heater c25, which is connected to the X axis angular rate detecting unit c21, the Y axis accelerometer c22, and the first front-end circuit c23, for maintaining the predetermined operational temperature of the X axis angular rate detecting unit c21, the Y axis accelerometer c22, and the first front-end circuit c23;
- a second heater c45, which is connected to the Y axis angular rate detecting unit c41, the X axis accelerometer c42, and the second front-end circuit c43, for maintaining the predetermined operational temperature of the X axis angular rate detecting unit c41, the X axis accelerometer c42, and the second front-end circuit c43; and
- a third heater c75, which is connected to the Z axis angular rate detecting unit c71, the Z axis accelerometer c72, and the third front-end circuit c73, for maintaining the predetermined operational temperature of the Z axis angular rate detecting unit c71, the Z axis accelerometer c72, and the third front-end circuit c73.

Referred to FIGS. 6, 15, 16, 25, and 26, the thermal processor c30 of the preferred embodiment of the present invention further comprises three identical thermal control circuitries c923 and the thermal control computation modules c911 running the DSP chipset c91.

Figure 29:
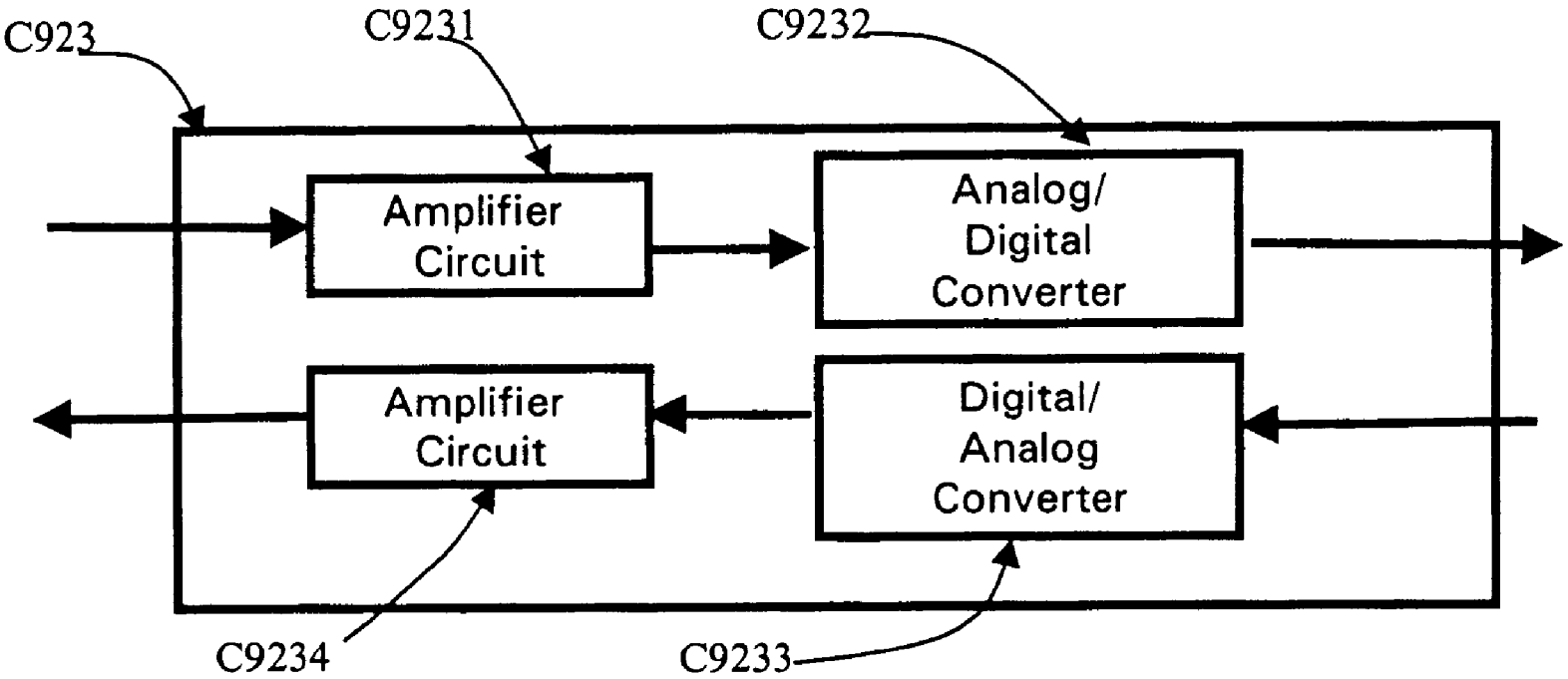
FIG. 29 is a block diagram of the thermal control circuit of the. ASIC chip in the third circuit board of the micro IMU according to the above preferred embodiment of the present invention.

As shown in FIGS. 23 and 29, each of the thermal control circuitries c923 further comprises:

- a first amplifier circuit c9231, which is connected with the respective X axis, Y axis or Z axis thermal sensing producer c24, c44, c74, for amplifying the signals and suppressing the noise residing in the temperature voltage signals from the respective X axis, Y axis or. Z axis thermal sensing producer c24, c44, c74 and improving the signal-to-noise ratio;
- an analog/digital converter c9232, which is connected with the amplifier circuit c9231, for sampling the temperature voltage signals and digitizing the sampled temperature voltage signals to digital signals, which are output to the thermal control computation module c911;
- a digital/analog converter c9233 which converts the digital temperature commands input from the thermal control computation module c911 into analog signals; and a second amplifier circuit c9234, which receives the analog signals from the digital/analog converter 9233, amplifying the input analog signals from the digital/analog converter c9233 for driving the respective first, second or third heater c25, c45, c75; and closing the temperature controlling loop.

The thermal control computation module c911 computes digital temperature commands using the digital temperature voltage signals from the analog/digital converter c9232, the temperature sensor scale factor, and the predetermined operating temperature of the angular rate producer and acceleration producer, wherein the digital temperature commands are connected to the digital/analog converter c9233.

Figure 17:
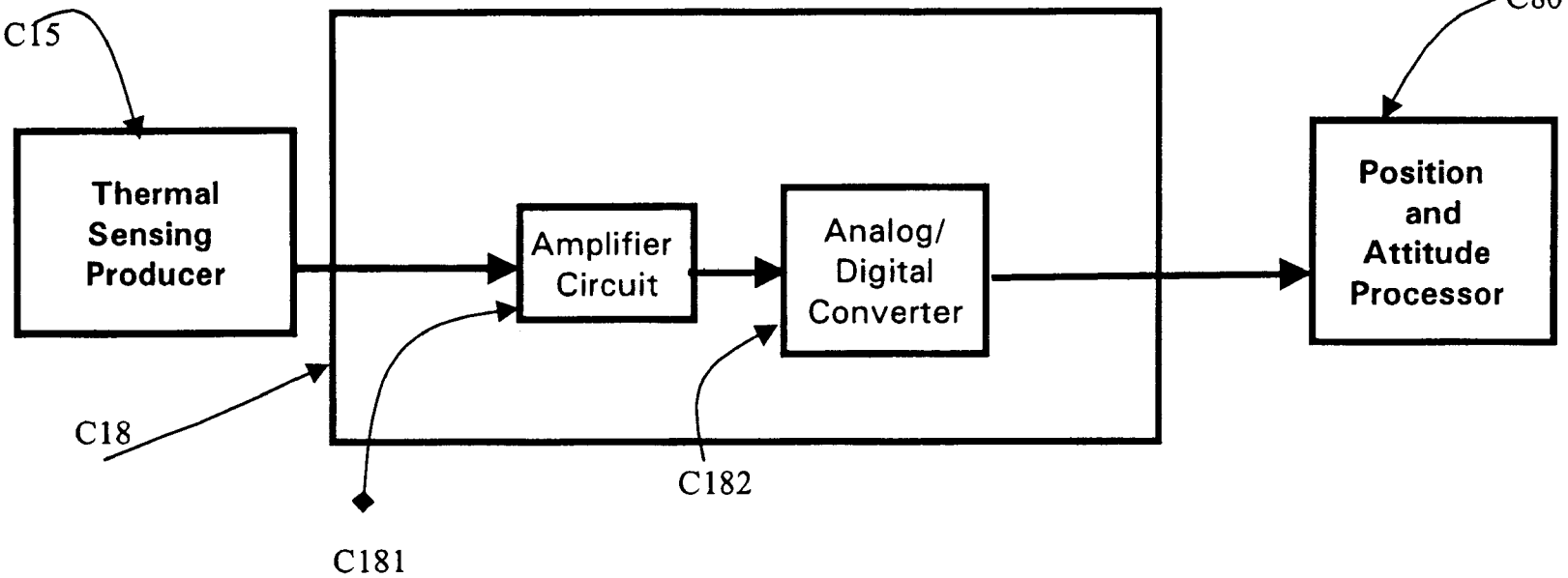
FIG. 17 is a block diagram illustrating a temperature digitizer for outputting analog voltage signals of the thermal sensing producer according to the above preferred embodiment of the present invention.

In order to achieve a high degree of full functional performance for the micro IMU, a specific package of the first circuit board c2, the second circuit board c4, the third circuit board c7, and the control circuit board c9 of the preferred embodiment of the present invention is provided and disclosed as follows:

In the preferred embodiment of the present invention, as shown in FIGS. 21, 17, and 18, the third circuit board c7 is bonded to a supporting structure by means of a conductive epoxy, and the first circuit board c2, the second circuit board c4, and the control circuit board c9 are arranged in parallel to bond to the third circuit board c7 perpendicularly by a non conductive epoxy.

In other words, the first circuit board c2, the second circuit board c4, and the control circuit board c9 are soldered to the third circuit board c7 in such a way as to use the third circuit board c7 as an interconnect board, thereby avoiding the necessity to provide interconnect wiring, so as to minimize the small size.

The first, second, third, and control circuit boards c2, c4, c7, and c9 are constructed using ground planes which are brought out to the perimeter of each circuit board c2, c4, c7, c9, so that the conductive epoxy can form a continuous ground plane with the supporting structure. In this way the electrical noise levels are minimized and the thermal gradients are reduced. Moreover, the bonding process also reduces the change in misalignments due to structural bending caused by acceleration of the IMU.

What is claimed is:

1. A method for pointing and stabilizing a device, comprising the steps of:

(a) identifying a desired pointing direction of said device by providing coordinates of a target by a target coordinate producer;

(b) measuring and compensating said desired pointing direction to produce a current digital attitude measurement of said device by means of a MEMS (MicroElectroMechanical System) attitude producer;

(c) computing rotation commands of said device to an actuator by comparing said desired pointing direction of said device and said current digital attitude measurements of said device by means of a pointing controller;

(d) rotating said device to said desired pointing direction by said actuator according to said rotation commands; and (e) illustrating said target and desired pointing direction and current direction of said device.

2. A method for pointing and stabilizing a device, comprising the steps of:

(a) identifying a desired pointing direction of said device by providing coordinates of a target by a target coordinate producer;

(b) determining a current attitude measurement of said device by means of an attitude producer; p1 (c) computing rotation commands of said device using said desired pointing direction of said device and said current attitude measurements of said device by means of a pointing controller;

(d) rotating said device to said desired pointing direction by an actuator;

(e) illustrating said target and desired pointing direction and current direction of said device; and (f) producing a voice representing pointing procedure.

3. The method, as recited in claim 2, wherein step (c) further comprises said steps of, c.1 transforming target positioning measurements, measured by said target coordinate producer and corrupted with measurement noise, from said target coordinate producer body coordinates to local level coordinates;

c.2 yielding a current target state including target position estimation using said target positioning measurements measured by said target coordinate producer;

c.3 predicting a future target trajectory and calculating an interception position and time of a projectile launched said device and said target;

c.4 producing device azimuth and elevation required for launch of said projectile; and c.5 producing control commands to said actuator using said device azimuth and elevation and said current attitude and attitude rate data of said device from said inertial measurement unit to stabilize and implement said device azimuth and elevation with disturbance rejection.

4. The method, as recited in claim 3, wherein the step (c.3) further comprises the steps of:

c.3.1 extrapolating said future trajectory of said projectile using said current target state, including a current target position estimation and system dynamic matrix;

c.3.2 computing a time of said projectile to fly from said device to said interception position; and c.3.3 computing said interception position and time using said predicted future projectile trajectory and projectile flight time.

5. The method, as recited in claim 2, 3 or 4, wherein said attitude producer is an inertial measurement unit (IMU) which is an IMU/AHRS.

6. A method for pointing and stabilizing a device, comprising the steps of:

(a) identifying a desired pointing direction of said device by providing coordinates of a target by a target coordinate producer;

(b) determining a current attitude measurement of said device by means of an attitude producer;

(c) computing rotation commands of said device using said desired pointing direction of said device and said current attitude measurements of said device by means of a pointing controller;

(d) rotating said device to said desired pointing direction by an actuator; and (e) illustrating said target and desired pointing direction and current direction of said device;

wherein the step (c) further comprises the steps of, c.1 transforming target positioning measurements, measured by said target coordinate producer and corrupted with measurement noise, from said target coordinate producer body coordinates to local level coordinates;

c.2 yielding a current target state including target position estimation using said target positioning measurements measured by said target coordinate producer;

c.3 predicting a future target trajectory and calculating an interception position and time of a projectile launched said device and said target;

c.4 producing device azimuth and elevation required for launch of said projectile; and c.5 producing control commands to said actuator using said device azimuth and elevation and said current attitude and attitude rate data of said device from said inertial measurement unit to stabilize and implement said device azimuth and elevation with disturbance rejection.

7. The method, as recited in claim 6, wherein the step (c.3) further comprises the steps of:

c.3.1 extrapolating said future trajectory of said projectile using said current target state, including a current target position estimation and system dynamic matrix;

c.3.2 computing a time of said projectile to fly from said device to said interception position; and c.3.3 computing said interception position and time using said predicted future projectile trajectory and projectile flight time.

8. The method, as recited in claim 1, 6 or 7, wherein said attitude producer is an inertial measurement unit which is an IMU/AHRS.

9. A system for pointing and stabilizing a device, comprising:

a MEMS (MicroElectroMechanical System) attitude producer measuring and compensating a desired point direction of said device to produce a current digital attitude measurement and an attitude rate measurement of said device;

a target coordinate producer measuring said desired pointing direction of said device by acquiring and tracking a target;

an actuator for rotating said device to said desired pointing direction; and a pointing controller computing rotation commands of said device to said actuator by comparing said desired pointing direction and said current attitude measurement of said device so as to rotate said device to said desired pointing direction by said actuator according to said rotation commands.

10. A system for pointing and stabilizing a device, comprising:

an attitude producer for determining a current attitude measurement and an attitude rate measurement of said device;

a target coordinate producer for measuring a desired pointing direction of said device by acquiring and tracking a target;

an actuator for rotating said device to said desired pointing direction;

a pointing controller for computing rotation commands to said actuator using said desired pointing direction of said device and said current attitude measurement of said device to rotate said device;

a visual and voice device for providing audio and visual means to improve a decision of an operation.

11. The system, as recited in claim 10, wherein said audio and visual means includes displaying said desired pointing direction and said current attitude measurement of said device and a target trajectory, and producing a voice representing pointing procedure.

12. The system, as recited in claim 11, wherein said actuator changes said current attitude of said device to bring said device into closer correspondence with a desired orientation.

13. The system, as recited in claim 11, wherein said system is capable of selectively rejecting and filtering out fluctuations by means of said pointing controller through an angle position feedback and an angular rate and acceleration feedback.

14. The system, as recited in claim 11, wherein said target coordinate producer includes a radar and laser rangefinder, wherein said coordinates of said target are electronically relayed to said pointing controller through said visual and voice device.

15. The system, as recited in claim 11, wherein said actuator includes a machine gunner, slews said gun barrel boresight toward said precise coordinates of said target, wherein said visual and voice device shows a location of said target and said pointing procedure, therefore after said target from said display is selected, said target coordinates are automatically relayed to said pointing controller, as well as said current attitude measurement of said device from said attitude producer.

16. The system, as recited in claim 11, wherein said pointing controller further comprises:

a measurement data processing module for transforming said target positioning measurements, measured by said target coordinate producer and corrupted with measurement noise, from said target coordinate producer body coordinates to local level coordinates;

a target position estimator for yielding said current target state including target position estimation using said target positioning measurements;

a target position predictor for predicting a future target trajectory and calculating an interception position and time of a projectile launched by said device and said target;

a fire control solution module for producing a device azimuth and elevation required for launch of said projectile; and a device control command computation module for producing control commands to said actuator using said required device azimuth and elevation, said current attitude measurement and said attitude rate measurement of said device from said attitude producer to stabilize and implement said required device azimuth and elevation with disturbance rejection.

17. The system, as recited in claim 16, wherein said target position estimator is a Kalman filter.

18. The system, as recited in claim 17, wherein said measurement data processing module maps nonlinearly radar measurements presented in radar antenna coordinates into said local level orthogonal coordinates.

19. The system, as recited in claim 16, wherein said target position predictor further comprises:

a target position extrapolation module for extrapolating said future trajectory of said projectile using a current target state including a target position estimation and a system dynamic matrix;

a projectile flight time calculation module for computing a time of said projectile to fly from said device to said interception position; and an interception position and time determination module for computing said interception position and time using said predicted future projectile trajectory and projectile flight time; wherein once said predicted target trajectory is determined, a first time for said projectile to fly from said device to each point of said predicted target trajectory and a second time for said target to fly to said point is calculated, and thus said interception position is able to be determined since, for said interception point, said first time is equal to said second time.

20. The system, as recited in claim 19, wherein said fire control solution module gives said required device azimuth and elevation by means of said given interception time and position from said target position predictor.

21. The system, as recited in claim 20, wherein said device control command computation module computes said rotation commands to said actuator using a desired device tip azimuth and an elevation from said fire control solution module and said current attitude and attitude rate data from said attitude producer to place a device tip to said desired position and stabilize said device tip at a desired position with any disturbance rejection.

22. The system, as recited in claim 21, wherein said device control command computation module is a digital controller and definitely essential to isolate said device from vibrations while maintaining precision stabilization and pointing performance.

23. The system, as recited in claim 22, wherein said visual and voice device is designed to display said target of a field of view of a device motion and projectile and target flight trajectories during an interception process.

24. The system, as recited in claim 22, wherein said attitude producer includes an inertial measurement unit (IMU).

25. The system, as recited in claim 22, wherein said attitude producer includes a global positioning system (GPS) attitude receiver.

26. The system, as recited in claim 22, wherein said visual and voice device is a hand-held device.

27. The system, as recited in claim 11, wherein said visual and voice device is designed to display said target of a field of view of a device motion and projectile and target flight trajectories during an interception process.

28. The system, as recited in claim 10, wherein said attitude producer includes an inertial measurement unit (IMU).

29. The system, as recited in claim 11, wherein said attitude producer includes an inertial measurement unit (IMU).

30. The system, as recited in claims 28, 29 or 24, wherein said inertial measurement unit is a micro inertial measurement unit which comprises:

an angular rate producer for producing X axis, Y axis and Z axis angular rate electrical signals;

an acceleration producer for producing X axis, Y axis and Z axis acceleration electrical signals; and an angular increment and velocity increment producer for converting said X axis, Y axis and Z axis angular rate electrical signals into digital angular increments and converting said input X axis, Y axis and Z axis acceleration electrical signals into digital velocity increments.

31. The system, as recited in claim 30, wherein said micro inertial measurement unit further comprises a thermal controlling means for maintaining a predetermined operating temperature of said angular rate producer, said acceleration producer and said angular increment and velocity increment producer.

32. The system, as recited in claim 31, wherein said thermal controlling means comprises a thermal sensing producer device, a heater device and a thermal processor, wherein said thermal sensing producer device, which produces temperature signals, is processed in parallel with said angular rate producer and said acceleration producer for maintaining a predetermined operating temperature of said angular rate producer and said acceleration producer and angular increment and velocity increment producer, wherein said predetermined operating temperature is a constant designated temperature selected between 150° F. and 185° F., wherein said temperature signals produced from said thermal sensing producer device are input to said thermal processor for computing temperature control commands using said temperature signals, a temperature scale factor, and a predetermined operating temperature of said angular rate producer and said acceleration producer, and produce driving signals to said heater device using said temperature control commands for controlling said heater device to provide adequate heat for maintaining said predetermined operating temperature in said micro inertial measurement unit.

33. The system, as recited in claim 32, wherein said X axis, Y axis and Z axis angular rate electrical signals produced from said angular producer are analog angular rate voltage signals directly proportional to angular rates of a carrier carrying said micro inertial measurement unit, and said X axis, Y axis and Z axis acceleration electrical signals produced from said acceleration producer are analog acceleration voltage signals directly proportional to accelerations of said vehicle.

34. The system, as recited in claim 33, wherein said angular increment and velocity increment producer comprises:

an angular integrating means and an acceleration integrating means, which are adapted for respectively integrating said X axis, Y axis and Z axis analog angular rate voltage signals and said X axis, Y axis and Z axis analog acceleration voltage signals for a predetermined time interval to accumulate said X axis, Y axis and Z axis analog angular rate voltage signals and said X axis, Y axis and Z axis analog acceleration voltage signals as a raw X axis, Y axis and Z axis angular increment and a raw X axis, Y axis and Z axis velocity increment for a predetermined time interval to achieve accumulated angular increments and accumulated velocity increments, wherein said integration is performed to remove noise signals that are non-directly proportional to said carrier angular rate and acceleration within said X axis, Y axis and Z axis analog angular rate voltage signals and said X axis, Y axis and Z axis analog acceleration voltage signals, to improve signal-to-noise ratio, and to remove said high frequency signals in said X axis, Y axis and Z axis analog angular rate voltage signals and said X axis, Y axis and Z axis analog acceleration voltage signals;

a resetting means which forms an angular reset voltage pulse and a velocity reset voltage pulse as an angular scale and a velocity scale which are input into said angular integrating means and said acceleration integrating means respectively; and an angular increment and velocity increment measurement means which is adapted for measuring said voltage values of said X axis, Y axis and Z axis accumulated angular increments and said X axis, Y axis and Z axis accumulated velocity increments with said angular reset voltage pulse and said velocity reset voltage pulse respectively to acquire angular increment counts and velocity increment counts as a digital form of angular increment and velocity increment measurements respectively.

35. The system, as recited in claim 34, wherein said angular increment and velocity increment measurement means also scales said voltage values of said X axis, Y axis and Z axis accumulated angular and velocity increments into real X axis, Y axis and Z axis angular and velocity increment voltage values, wherein in said angular integrating means and said accelerating integrating means, said X axis, Y axis and Z axis analog angular voltage signals and said X axis, Y axis and Z axis analog acceleration voltage signals are each reset to accumulate from a zero value at an initial point of every said predetermined time interval.

36. The system, as recited in claim 35, wherein said resetting means comprises an oscillator, wherein said angular reset voltage pulse and said velocity reset voltage pulse are implemented by producing a timing pulse by said oscillator.

37. The system, as recited in claim 36, wherein said angular increment and velocity increment measurement means, which is adapted for measuring said voltage values of said X axis, Y axis and Z axis accumulated angular and velocity increments, comprises an analog/digital converter to substantially digitize said raw X axis, Y axis and Z axis angular increment and velocity increment voltage values into digital X axis, Y axis and Z axis angular increment and velocity increments.

38. The system, as recited in claim 37, wherein said angular integrating means of said angular increment and velocity increment producer comprises an angular integrator circuit for receiving said amplified X axis, Y axis and Z axis analog angular rate signals from said angular amplifier circuit and integrating to form said accumulated angular increments, and said acceleration integrating means of said angular increment and velocity increment producer comprises an acceleration integrator circuit for receiving said amplified X axis, Y axis and Z axis analog acceleration signals from said acceleration amplifier circuit and integrating to form said accumulated velocity increments.

39. The system, as recited in claim 38, wherein said angular increment and velocity increment producer further comprises an angular amplifying circuit for amplifying said X axis, Y axis and Z axis analog angular rate voltage signals to form amplified X axis, Y axis and Z axis analog angular rate signals and an acceleration amplifying circuit for amplifying said X axis, Y axis and Z axis analog acceleration voltage signals to form amplified X axis, Y axis and Z axis analog acceleration signals.

40. The system, as recited in claim 39, wherein said angular integrating means of said angular increment and velocity increment producer comprises an angular integrator circuit for receiving said amplified X axis, Y axis and Z axis analog angular rate signals from said angular amplifier circuit and integrating to form said accumulated angular increments, and said acceleration integrating means of said angular increment and velocity increment producer comprises an acceleration integrator circuit for receiving said amplified X axis, Y axis and Z axis analog acceleration signals from said acceleration amplifier circuit and integrating to form said accumulated velocity increments.

41. The system, as recited in claim 40, wherein said analog/digital converter of said angular increment and velocity increment producer further includes an angular analog/digital converter, a velocity analog/digital converter and an input/output interface circuit, wherein said accumulated angular increments output from said angular integrator circuit and said accumulated velocity increments output from said acceleration integrator circuit are input into said angular analog/digital converter and said velocity analog/digital converter respectively, wherein said accumulated angular increments is digitized by said angular analog/digital converter by measuring said accumulated angular increments with said angular reset voltage pulse to form a digital angular measurements of voltage in terms of said angular increment counts which is output to said input/output interface circuit to generate digital X axis, Y axis and Z axis angular increment voltage values, wherein said accumulated velocity increments are digitized by said velocity analog/digital converter by measuring said accumulated velocity increments with said velocity reset voltage pulse to form digital velocity measurements of voltage in terms of said velocity increment counts which is output to said input/output interface circuit to generate digital X axis, Y axis and Z axis velocity increment voltage values.

42. The system, as recited in claim 41, wherein said thermal processor comprises an analog/digital converter connected to said thermal sensing producer device, a digital/analog converter connected to said heater device, and a temperature controller connected with both said analog/digital converter and said digital/analog converter, wherein said analog/digital converter inputs said temperature voltage signals produced by said thermal sensing producer device, wherein said temperature voltage signals are sampled in said analog/digital converter to sampled temperature voltage signals which are further digitized to digital signals and output to said temperature controller which computes digital temperature commands using said input digital signals from said analog/digital converter, a temperature sensor scale factor, and a pre-determined operating temperature of said angular rate producer and acceleration producer, wherein said digital temperature commands are fed back to said digital/analog converter, wherein said digital/analog converter converts said digital temperature commands input from said temperature controller into analog signals which are output to said heater device to provide adequate heat for maintaining said predetermined operating temperature of said micro inertial measurement unit.

43. The system, as recited in claim 42, wherein said thermal processor further comprises:

a first amplifier circuit between said thermal sensing producer device and said digital/analog converter, wherein said voltage signals from said thermal sensing producer device is first input into said first amplifier circuit for amplifying said signals and suppressing said noise residing in said voltage signals and improving said signal-to-noise ratio, wherein said amplified voltage signals are then output to said analog/digital converter; and a second amplifier circuit between said digital/analog converter and heater device for amplifying said input analog signals from said digital/analog converter for driving said heater device.

44. The system, as recited in claim 43, wherein said thermal processor further comprises an input/output interface circuit connected said analog/digital converter and digital/analog converter with said temperature controller, wherein said voltage signals are sampled in said analog/digital converter to form sampled voltage signals that are digitized into digital signals, and said digital signals are output to said input/output interface circuit, wherein said temperature controller is adapted to compute said digital temperature commands using said input digital temperature voltage signals from said input/output interface circuit, said temperature sensor scale factor, and said pre-determined operating temperature of said angular rate producer and acceleration producer, wherein said digital temperature commands are fed back to said input/output interface circuit, moreover said digital/analog converter further converts said digital temperature commands input from said input/output interface circuit into analog signals which are output to said heater device to provide adequate heat for maintaining said predetermined operating temperature of said micro inertial measurement unit.

45. The system, as recited in claim 31, wherein said X axis, Y axis and Z axis angular rate electrical signals produced from said angular producer are analog angular rate voltage signals directly proportional to angular rates of a carrier carrying said micro inertial measurement unit, and said X axis, Y axis and Z axis acceleration electrical signals produced from said acceleration producer are analog acceleration voltage signals directly proportional to accelerations of said vehicle.

46. The system, as recited in claim 30, wherein said micro IMU comprises a first circuit board, a second circuit board, a third circuit board, and a control circuit board arranged inside a case, said first circuit board being connected with said third circuit board for producing X axis angular sensing signal and Y axis acceleration sensing signal to said control circuit board, said second circuit board being connected with said third circuit board for producing Y axis angular sensing signal and X axis acceleration sensing signal to said control circuit board, said third circuit board being connected with said control circuit board for producing Z axis angular sensing signal and Z axis acceleration sensing signals to said control circuit board, wherein said control circuit board is connected with said first circuit board and then said second circuit board through said third circuit board for processing said X axis, Y axis and Z axis angular sensing signals and said X axis, Y axis and Z axis acceleration sensing signals from said first, second and control circuit board to produce digital angular increments and velocity increments, position, velocity, and attitude solution.

47. The system, as recited in claim 46, wherein said angular producer comprises:

a X axis vibrating type angular rate detecting unit and a first front-end circuit connected on said first circuit board;

a Y axis vibrating type angular rate detecting unit and a second front-end circuit connected on said second circuit board;

a Z axis vibrating type angular rate detecting unit and a third front-end circuit connected on said third circuit board;

three angular signal loop circuitries which are provided on said control circuit board for said first, second and third circuit boards respectively;

three dither motion control circuitries which are provided on in said control circuit board for said first, second and third circuit boards respectively;

an oscillator adapted for providing reference pickoff signals for said X axis vibrating type angular rate detecting unit, said Y axis vibrating type angular rate detecting unit, said Z axis vibrating type angular rate detecting unit, said angle signal loop circuitry, and said dither motion control circuitry; and three dither motion processing modules provided on said control circuit board, for said first, second and third circuit boards respectively.

48. The system, as recited in claim 47, wherein said acceleration producer comprises:

a X axis accelerometer, which is provided on said second circuit board and connected with said angular increment and velocity increment producer provided on said control circuit board;

a Y axis accelerometer, which is provided on said first circuit board and connected with angular increment and velocity increment producer provided on said control circuit board; and a Z axis accelerometer, which is provided on said third circuit board and connected with angular increment and velocity increment producer provided on said control circuit board.

49. The system, as recited in claim 48, wherein said first, second and third front-end circuits are used to condition said output signal of said X axis, Y axis and Z axis vibrating type angular rate detecting units respectively and each further comprises:

a trans impedance amplifier circuit, which is connected to said respective X axis, Y axis or Z axis vibrating type angular rate detecting unit for changing said output impedance of said dither motion signals from a very high level, greater than 100 million ohms, to a low level, less than 100 ohms to achieve two dither displacement signals, which are A/C voltage signals representing said displacement between said inertial elements and said anchor combs, wherein said two dither displacement signals are output to said dither motion control circuitry; and a high-pass filter circuit, which is connected with said respective X axis, Y axis or Z axis vibrating type angular rate detecting unit for removing residual dither drive signals and noise from said dither displacement differential signal to form a filtered dither displacement differential signal to said angular signal loop circuitry.

50. The system, as recited in claim 49, wherein each of said X axis, Y axis and Z axis angular rate detecting units is a vibratory device, which comprises at least one set of vibrating inertial elements, including tuning forks, and associated supporting structures and means, including capacitive readout means, and uses Coriolis effects to detect angular rates of said carrier, wherein each of said X axis, Y axis and Z axis vibrating type angular rate detecting units receives dither drive signals from said respective dither motion control circuitry, keeping said inertial elements oscillating; and carrier reference oscillation signals from said oscillator, including capacitive pickoff excitation signals, wherein each of said X axis, Y axis and Z axis vibrating type angular rate detecting units detects said angular motion in X axis, Y axis and Z axis respectively of said carrier in accordance with said dynamic theory, wherein each of said X axis, Y axis and Z axis vibrating type angular rate detecting units outputs angular motion-induced signals, including rate displacement signals which may be modulated carrier reference oscillation signals to said trans Impedance amplifier circuit of said respective first, second or third front-end circuits; and inertial element dither motion signals thereof, including dither displacement signals, to said high-pass filter of said respective first, second or third front-end circuit.

51. The system, as recited in claim 50, wherein said three dither motion control circuitries receive said inertial element dither motion signals from said X axis, Y axis and Z axis vibrating type angular rate detecting units respectively, reference pickoff signals from said oscillator, and produce digital inertial element displacement signals with known phase, wherein each said dither motion control circuitries comprises:

an amplifier and summer circuit connected to said trans impedance amplifier circuit of said respective first, second or third front-end circuit for amplifying said two dither displacement signals for more than ten times and enhancing said sensitivity for combining said two dither displacement signals to achieve a dither displacement differential signal by subtracting a center anchor comb signal with a side anchor comb signal;

a high-pass filter circuit connected to said amplifier and summer circuit for removing residual dither drive signals and noise from said dither displacement differential signal to form a filtered dither displacement differential signal;

a demodulator circuit connected to said high-pass filter circuit for receiving said capacitive pickoff excitation signals as phase reference signals from said oscillator and said filtered dither displacement differential signal from said high-pass filter and extracting said in-phase portion of said filtered dither displacement differential signal to produce an inertial element displacement signal with known phase;

a low-pass filter connected to said demodulator circuit for removing high frequency noise from said inertial element displacement signal input thereto to form a low frequency inertial element displacement signal;

an analog/digital converter connected to said low-pass filter for converting said low frequency inertial element displacement signal that is an analog signal to produce a digitized low frequency inertial element displacement signal to said respective dither motion processing module;

a digital/analog converter processing said selected amplitude from said respective dither motion processing module to form a dither drive signal with correct amplitude; and an amplifier which generates and amplifies said dither drive signal to said respective X axis, Y axis or Z axis vibrating type angular rate detecting unit based on said dither drive signal with said selected frequency and correct amplitude.

52. The system, as recited in claim 51, wherein said oscillation of said inertial elements residing inside each of said X axis, Y axis and Z axis vibrating type angular rate detecting units is generally driven by a high frequency sinusoidal signal with precise amplitude, wherein each of said dither motion processing module receives digital inertial element displacement signals with known phase from said analog/digital converter of said dither motion control circuitry for finding said frequencies which have highest Quality Factor (Q) Values, locking said frequency, and locking said amplitude to produce a dither drive signal, including high frequency sinusoidal signals with a precise amplitude, to said respective X axis, Y axis or Z axis vibrating type angular rate detecting unit to keep said inertial elements oscillating at said predetermined resonant frequency.

53. The system, as recited in claim 52, wherein said dither motion processing module further includes a discrete Fast Fourier Transform (FFT) module, a memory array of frequency and amplitude data module, a maxima detection logic module, and a Q analysis and selection logic module to find said frequencies which have highest Quality Factor (Q) Values;

wherein said discrete Fast Fourier Transform (FFT) module is arranged for transforming said digitized low frequency inertial element displacement signal from said analog/digital converter of said dither motion control circuitry to form amplitude data with said frequency spectrum of said input inertial element displacement signal;

wherein said memory array of frequency and amplitude data module receives said amplitude data with frequency spectrum to form an array of amplitude data with frequency spectrum;

wherein said maxima detection logic module is adapted for partitioning said frequency spectrum from said array of said amplitude data with frequency into plural spectrum segments, and choosing said frequencies with said largest amplitudes in said local segments of said frequency spectrum; and wherein said Q analysis and selection logic module is adapted for performing Q analysis on said chosen frequencies to select frequency and amplitude by computing said ratio of amplitude/bandwidth, wherein a range for computing bandwidth is between +−½ of said peek for each maximum frequency point.

54. The system, as recited in claim 11, wherein said attitude producer includes a global positioning system (GPS) attitude receiver.

55. The system, as recited in claim 11, wherein said visual and voice device is a hand-held device.

56. The system, as recited in claim 10, wherein said pointing controller further comprises:

a measurement data processing module for transforming said target positioning measurements, measured by said target coordinate producer and corrupted with measurement noise, from said target coordinate producer body coordinates to local level coordinates;

a target position estimator for yielding said current target state including target position estimation using said target positioning measurements;

a target position predictor for predicting a future target trajectory and calculating an interception position and time of a projectile launched by said device and said target;

a fire control solution module for producing a device azimuth and elevation required for launch of said projectile; and a device control command computation module for producing control commands to said actuator using said required device azimuth and elevation, said current attitude measurement and said attitude rate measurement of said device from said attitude producer to stabilize and implement said required device azimuth and elevation with disturbance rejection.

57. The system, as recited in claim 56, wherein said target position estimator is a Kalman filter.

58. The system, as recited in claim 57, wherein said measurement data processing module maps nonlinearly radar measurements presented in radar antenna coordinates into said local level orthogonal coordinates.

59. The system, as recited in claim 56, wherein said target position predictor further comprises:

a target position extrapolation module for extrapolating said future trajectory of said projectile using a current target state including a target position estimation and a system dynamic matrix;

a projectile flight time calculation module for computing a time of said projectile to fly from said device to said interception position; and an interception position and time determination module for computing said interception position and time using said predicted future projectile trajectory and projectile flight time; wherein once said predicted target trajectory is determined, a first time for said projectile to fly from said device to each point of said predicted target trajectory and a second time for said target to fly to said point is calculated, and thus said interception position is able to be determined since, for said interception point, said first time is equal to said second time.

60. The system, as recited in claim 59, wherein said fire control solution module gives said required device azimuth and elevation by means of said given interception time and position from said target position predictor.

61. The system, as recited in claim 60, wherein said device control command computation module computes said rotation commands to said actuator using a desired device tip azimuth and an elevation from said fire control solution module and said current attitude and attitude rate data from said attitude producer to place a device tip to said desired position and stabilize said device tip at a desired position with any disturbance rejection.

62. The system, as recited in claim 61, wherein said device control command computation module is a digital controller and definitely essential to isolate said device from vibrations while maintaining precision stabilization and pointing performance.

* * * * *